US006896346B2

(12) United States Patent
Trauernicht et al.

(10) Patent No.: US 6,896,346 B2
(45) Date of Patent: May 24, 2005

(54) THERMO-MECHANICAL ACTUATOR DROP-ON-DEMAND APPARATUS AND METHOD WITH MULTIPLE DROP VOLUMES

(75) Inventors: David P. Trauernicht, Rochester, NY (US); John A. Lebens, Rush, NY (US); Stephen F. Pond, Oakton, VA (US)

(73) Assignee: Eastman Kodak Company, Rochester, NY (US)

( * ) Notice: Subject to any disclaimer, the term of this patent is extended or adjusted under 35 U.S.C. 154(b) by 48 days.

(21) Appl. No.: 10/329,566

(22) Filed: Dec. 26, 2002

(65) Prior Publication Data

US 2004/0146055 A1 Jul. 29, 2004

(51) Int. Cl.[7] ..... B41J 29/38; B41J 2/05

(52) U.S. Cl. ..... 347/9; 347/56

(58) Field of Search ..... 347/9, 15, 48, 347/56, 61

(56) References Cited

U.S. PATENT DOCUMENTS

| | | | | |
|---|---|---|---|---|
| 3,747,120 | A | 7/1973 | Stemme | 346/75 |
| 3,946,398 | A | 3/1976 | Kyser et al. | 346/1 |
| 4,296,421 | A | 10/1981 | Hara et al. | 346/140 R |
| 4,513,299 | A | 4/1985 | Lee et al. | 346/140 R |
| 4,577,201 | A | 3/1986 | Murakami et al. | 346/140 R |
| 5,202,659 | A | 4/1993 | DeBonte et al. | 346/1.1 |
| 5,361,084 | A | 11/1994 | Paton et al. | 347/15 |
| 5,599,695 | A | 2/1997 | Pease et al. | 435/91.1 |
| 5,689,291 | A | 11/1997 | Tence et al. | 347/10 |
| 5,726,690 | A | 3/1998 | Bohorquez et al. | 347/15 |
| 5,771,882 | A | 6/1998 | Psaros et al. | 128/203.12 |
| 5,801,732 | A | 9/1998 | Pengelly | 347/70 |
| 5,880,762 | A | 3/1999 | Ishinaga et al. | 347/62 |
| 5,902,648 | A | 5/1999 | Naka et al. | 427/558 |
| 5,933,168 | A | 8/1999 | Sakai | 347/70 |
| 5,997,124 | A | 12/1999 | Capps et al. | |
| 6,067,797 | A | 5/2000 | Silverbrook | 60/528 |
| 6,095,630 | A | 8/2000 | Horii et al. | 347/10 |
| 6,102,512 | A | 8/2000 | Torii et al. | 347/10 |
| 6,234,609 | B1 | 5/2001 | Silverbrook | 347/54 |
| 6,239,821 | B1 | 5/2001 | Silverbrook | 347/54 |

(Continued)

FOREIGN PATENT DOCUMENTS

| | | |
|---|---|---|
| JP | 20330543 | 1/1990 |
| WO | WO 0214076 | 2/2002 |

*Primary Examiner*—Michael S. Brooke
(74) *Attorney, Agent, or Firm*—William R. Zimmerli

(57) ABSTRACT

An apparatus and method of operating a liquid drop emitter, such as an ink jet device, for emitting liquid drops of different volumes. The liquid drop emitter comprises a chamber, filled with a liquid, having a nozzle for emitting drops of the liquid, a thermo-mechanical actuator having a moveable portion within the chamber for applying pressure to the liquid at the nozzle, and apparatus adapted to apply heat pulses to the thermo-mechanical actuator. The method for operating comprises applying a first heat pulse having a first power $P_1$, first pulse duration $\tau_{p1}$, and first energy $E_1=P_1\times\tau_{p1}$, displacing the movable portion of the actuator so that a drop is emitted having a first drop volume $V_{d1}$, and traveling substantially at the target velocity $v_0$; and applying a second heat pulse having a second power $P_2$, second pulse duration $\tau_{p2}$, and second energy $E_2=P_2\times\tau_{p2}$, displacing the movable portion of the actuator so that a drop is emitted having a second drop volume $V_{d2}$ and traveling substantially at the target velocity $v_0$, wherein $V_{d2}>V_{d1}$, $E_2>E_1$, $\tau_{p2}>\tau_{p1}$, and $P_2<P_1$. An alternate method for operating causes the emission of drops having different volumes traveling at different velocities wherein all velocities are within a predetermined drop velocity range, $v_{d\ min}$ to $v_{d\ max}$. Further methods for operating an ink jet printhead cause the emission of drops having different volumes and velocities wherein the triggering of the drop emission is delayed so as to result in synchronized arrival times at a print plane.

40 Claims, 18 Drawing Sheets

U.S. PATENT DOCUMENTS 6,254,793 B1 7/2001 Silverbrook ..... 216/27
6,274,056 B1 8/2001 Silverbrook ..... 216/27
6,318,847 B1 11/2001 Wade ..... 347/62
6,394,581 B1 5/2002 Silverbrook
6,435,666 B1 8/2002 Trauernicht et al.
2002/0097300 A1 7/2002 Silverbrook

| W(μm) | L(μm) | D(μm) | F(KHz) | $\tau_R$(μsec) | $\tau_D$(μsec) | $\tau_D/\tau_R$ |
|---|---|---|---|---|---|---|
| 15 | 115 | 45 | 36.6 | 27.32 | 14.40 | 0.53 |
| 20 | 115 | 45 | 42.7 | 23.42 | 15.80 | 0.67 |
| 30 | 115 | 45 | 50.3 | 19.88 | 17.80 | 0.90 |
| 15 | 115 | 35 | 51.4 | 19.46 | 13.40 | 0.69 |
| 25 | 115 | 40 | 53 | 18.87 | 16.00 | 0.85 |
| 15 | 115 | 30 | 60 | 16.67 | 11.70 | 0.70 |
| 30 | 95 | 45 | 65.6 | 15.24 | 11.00 | 0.72 |
| 25 | 95 | 40 | 71.6 | 13.97 | 10.00 | 0.72 |
| 30 | 95 | 40 | 74 | 13.51 | 10.40 | 0.77 |

THERMO-MECHANICAL ACTUATOR DROP-ON-DEMAND APPARATUS AND METHOD WITH MULTIPLE DROP VOLUMES

FIELD OF THE INVENTION

The present invention relates generally to drop-on-demand liquid emission devices, and, more particularly, to ink jet devices which employ thermo-mechanical actuators.

BACKGROUND OF THE INVENTION

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed that can be used with a broad range of liquid formulations. Apparatus and methods are needed that combine the advantages of microelectronic fabrication used for thermal ink jet with the liquid composition latitude available to piezo-electro-mechanical devices.

A DOD ink jet device that uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,234,609; and 6,239,821. Methods of manufacturing thermo-mechanical ink jet devices using microelectronic processes have been disclosed by K. Silverbrook in U.S. Pat. Nos. 6,254,793 and 6,274,056.

Thermo-mechanically actuated drop emitters are promising as low cost devices which can be mass produced using microelectronic materials and equipment and which allow operation with liquids that would be unreliable in a thermal ink jet device. In addition, apparatus and methods of operating liquid drop emitters so as to usefully generate drops having substantially different drop volumes would be highly desirable. Such apparatus and methods would allow a single drop emitter to provide different levels of the liquid per drop firing cycle. In ink jet printing this capability may be used to generate multiple image gray levels while preserving the printing speed associated with binary printing. The gray level printing capability of a single ink drop emitter may allow a printing system to be designed with fewer jets to achieve lower overall system cost or, alternatively, may be configured to achieve higher net printing speeds of gray level images at apparatus costs similar to a binary level printing system.

Some methods of emitting different ink drop volumes from drop-on-demand ink jet printheads have been disclosed and used previously. Use of fluid resonances for such purpose is known for piezoelectric drop-on-demand ink jet devices. In these known methods, the resonance of the ink meniscus at the nozzle, driven by surface tension effects, or the Helmholtz resonance of the ink chamber, driven by compliance effects, is used to change the volume or number of emitted drops. Tence et al. in U.S. Pat. No. 5,689,291 employ waveforms that drive piezoelectric transducers with spectral energy concentrations at frequencies associated with modal resonances of ink in the ink jet printhead orifices. Exciting different resonance modes of the ink meniscus causes the emission of different drop sizes.

DeBonte et al., in U.S. Pat. No. 5,202,659 disclose a method of operating a piezoelectric printhead using the dominant resonant frequency of the ink jet apparatus. This dominant resonance is described as the Helmholtz resonance of an individual jet chamber, which is excited by actuating the piezo transducer to first expand the jet chamber, waiting the resonance period, and then contracting the chamber to reinforce this resonance. This excitation process is repeated for multiple cycles to generate multiple merging drops for printing spots having different sizes.

Paton et al., in U.S. Pat. No. 5,361,084 disclose a method of multi-tone printing using a piezoelectric DOD printhead having elongated ink chambers and sidewall actuators, wherein an individual jet is excited using a packet of pulses so as to excite a longitudinal acoustic resonance in the jet channel that causes the emission of a number of discrete drops. Lee et al., in U.S. Pat. No. 4,513,299 disclose a similar use of acoustic resonance of the ink channels of a piezoelectric ink jet printhead.

The piezoelectric transducer used in a piezoelectric printhead may be driven to both compress and expand the ink fluid chamber, thereby allowing the ink meniscus at the nozzle to be pushed out or pulled inward. A variation in emitted drop volume may be achieved by manipulating the meniscus position and velocity by a sequence of compressive and expansive electrical pulses. Apparatus and methods of operating a piezoelectric drop-on-demand inkjet printhead in this fashion have been disclosed by S. Sakai in U.S. Pat. No. 5,933,168 and by Horii, et al., in U.S. Pat. No. 6,095,630.

Apparatus and methods of operating a thermal ink jet drop-on-demand printhead to create multiple drop volumes also have been disclosed. For example, Bohorquez, et al., in U.S. Pat. No. 5,726,690, describe a method of operating a thermal inkjet printhead that includes changing the pulse width of the driving electrical pulse, increasing the applied energy and thereby resulting in the emission of larger drops for larger energy inputs. Drop volumes that range in magnitude approximately 16% are disclosed.

Larger drop volume changes are reported for thermal ink jet apparatus and methods that are configured so that different areas of heater resistor can be energized. For example, Ishinaga, et al., in U.S. Pat. No. 5,880,762 discloses an apparatus having a plurality of heat generating resistors per ink nozzle chamber. The plurality of heat generating resistors are driven independently to cause the emission of several different drop volumes. J. Wade, in U.S. Pat. No. 6,318,847, discloses a segmented area heater resistor configuration that may be energized to generate a range of vapor bubble volumes causing the emission of differently sized drops.

Thermo-mechanical actuators are substantially smaller in scale than the piezoelectric actuators used in ink jet printheads and have mechanically different resonant behaviors. Thermo-mechanical actuators are more complex to fabricate than thermal ink jet heater resistors and, therefore, more difficult to construct in a multiple-actuator per jet configuration in analogous fashion to the disclosed thermal ink jet apparatus above noted. Apparatus and methods that generate variable drop volumes are needed which are adapted to the unique physical configurations, behaviors and capabilities of thermo-mechanical actuators.

SUMMARY OF THE INVENTION

It is an object of the present invention to provide a thermo-mechanical drop emitter and method of operating same to emit drops having substantially different volumes and substantially the same velocity.

It is also an object of the present invention to provide a thermo-mechanical drop emitter and method of operating same to emit drops having substantially different volumes and velocities within a pre-selected range.

It is also an object of the present invention to provide a method of operating an ink jet printhead to emit drops having substantially different volumes and velocities, the emissions of which are time-delayed so as to synchronize drop arrival times at a print plane.

The foregoing and numerous other features, objects and advantages of the present invention will become readily apparent upon a review of the detailed description, claims and drawings set forth herein. These features, objects and advantages are accomplished by operating a liquid drop emitter, such as an ink jet device, for emitting liquid drops of different volumes. The liquid drop emitter comprises a chamber, filled with a liquid, having a nozzle for emitting drops of the liquid, a thermo-mechanical actuator having a moveable portion within the chamber for applying pressure to the liquid at the nozzle, and apparatus adapted to apply heat pulses to the thermo-mechanical actuator. The method for operating comprises applying a first heat pulse having a first power $P_1$, first pulse duration $\tau_{p1}$, and first energy $E_1=P_1\times\tau_{p1}$, displacing the movable portion of the actuator so that a drop is emitted having a first drop volume $V_{d1}$ and traveling substantially at a target velocity $v_0$; and applying a second heat pulse having a second power $P_2$, second pulse duration $\tau_{p2}$, and second energy $E_2=P_2\times\tau_{p2}$, displacing the movable portion of the actuator so that a drop is emitted having a second drop volume $V_{d2}$ and traveling substantially at the target velocity $v_0$, wherein $V_{d2}>V_{d1}$, $E_2>E_1$, $\tau_{p2}>\tau_{p1}$ and $P_2<P_1$. Alternate methods for operating cause the emission of drops having substantially different volumes traveling at substantially different velocities wherein all velocities are within a pre-selected velocity range, $v_{min}$ to $v_{max}$.

The present invention is particularly useful for operating liquid drop emitters for DOD ink jet printing. Further methods for operating an ink jet printhead cause the emission of drops having different volumes and velocities wherein the triggering of the drop emission is delayed so as to result in synchronized arrival times at a print plane.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides an apparatus and method of operating a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermo-mechanical actuators so as to usefully emit drops having substantially different volumes.

Figure 1:
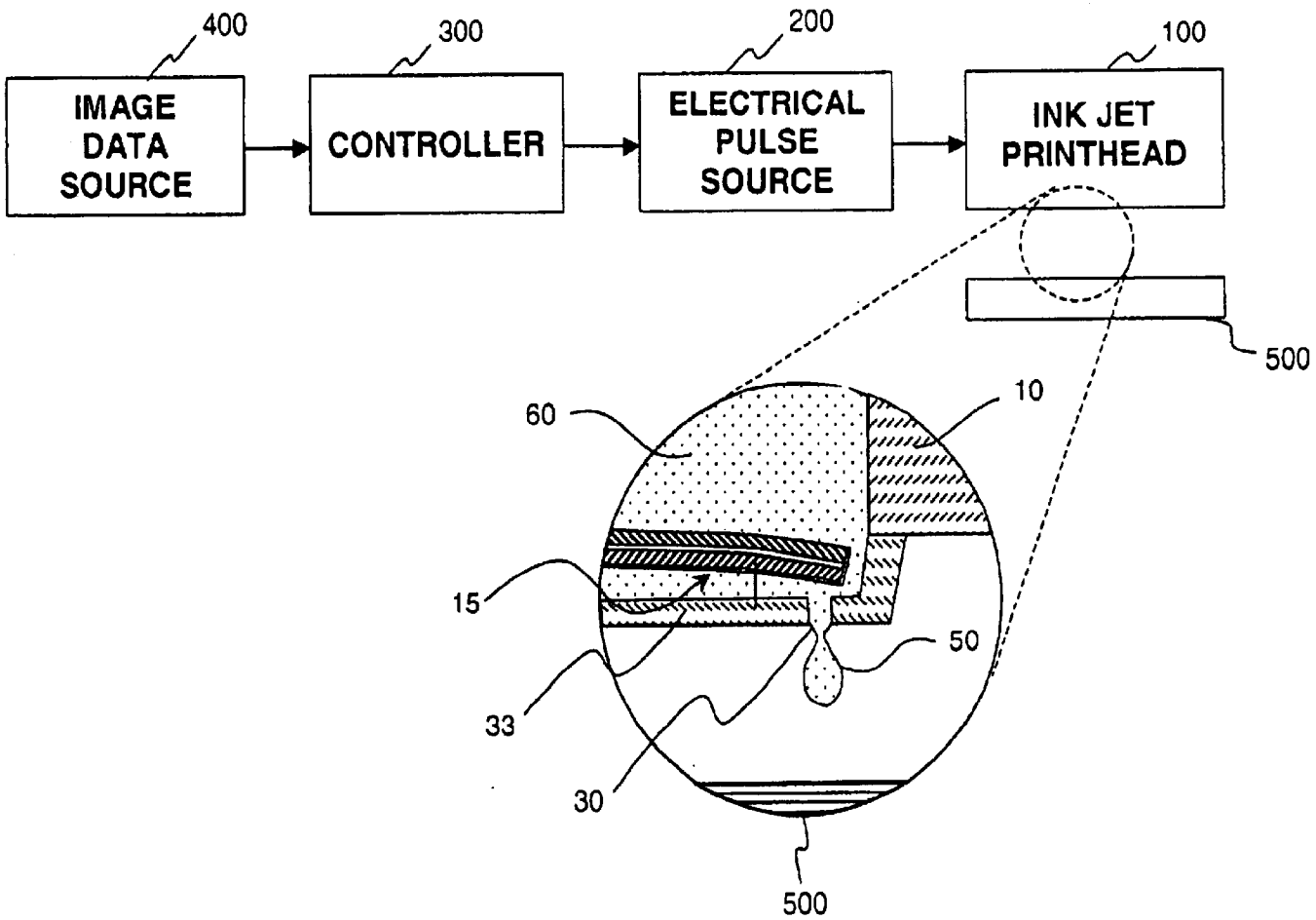
FIG. 1 is a schematic illustration of an ink jet system according to the present invention.

Turning first to FIG. 1, there is shown a schematic representation of an ink jet printing system that may use an apparatus manufactured by methods according to the present invention. The system includes an image data source 400 that provides signals received by controller 300 as commands to print drops. Controller 300 outputs signals to a source of electrical pulses 200. Pulse source 200, in turn, generates an electrical voltage signal composed of electrical energy pulses that are applied to electrically resistive means associated with each thermo-mechanical actuator 15 within ink jet printhead 100. The electrical energy pulses cause a thermo-mechanical actuator 15 to bend rapidly, pressurizing ink 60 located at nozzle 30, and emitting an ink drop 50 that lands on receiver or print plane 500.

Figure 2:
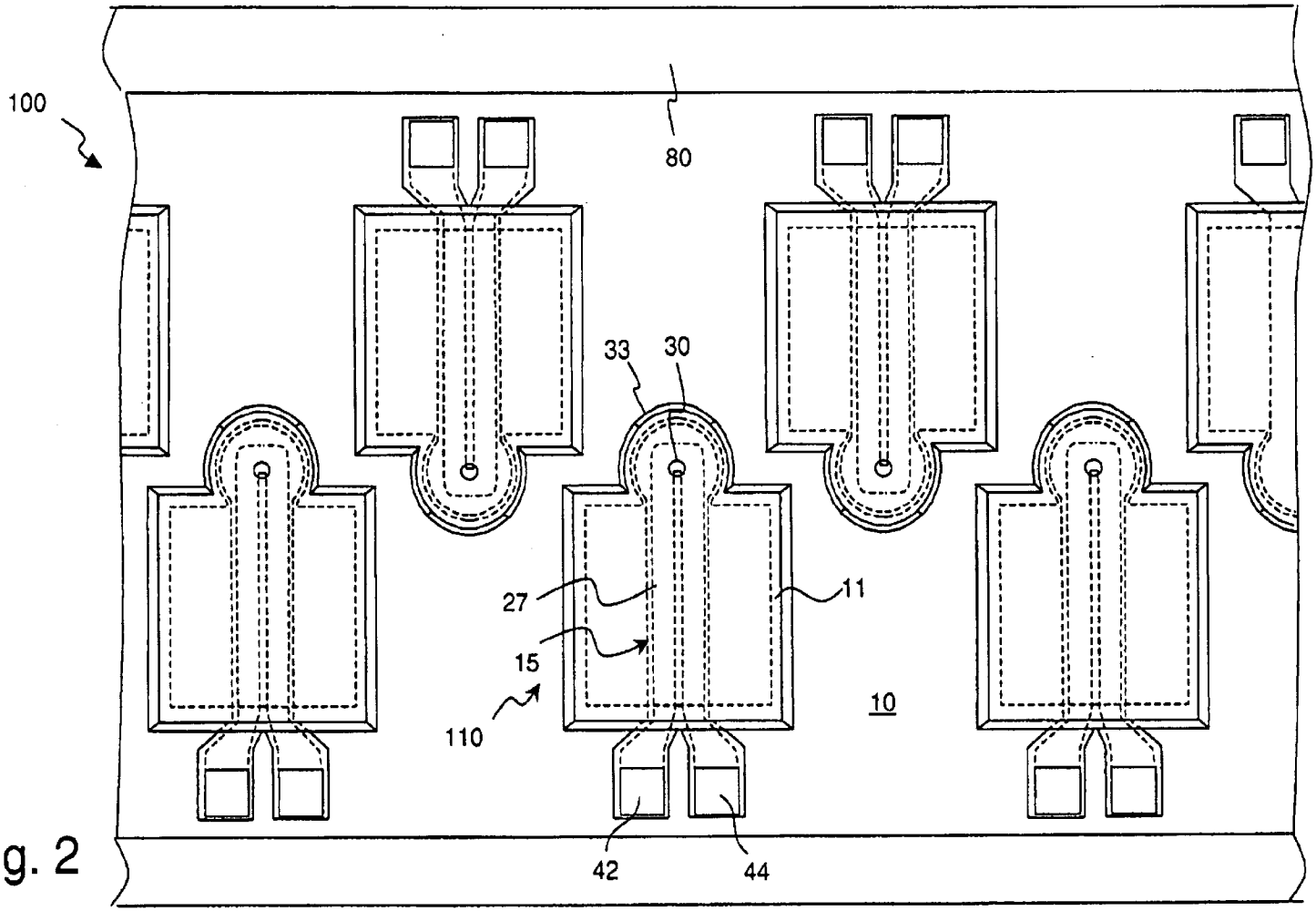
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and upper ink chambers 11 outwardly bounded by chamber structures 33, interdigitated in two rows. The ink jet units 110 are formed on and in a substrate 10 using microelectronic fabrication methods as described herein.

Each drop emitter unit 110 has associated electrical lead contacts 42, 44 that are formed with, or are electrically connected to, a u-shaped electrically resistive heater 27, shown in phantom view in FIG. 2. In the illustrated embodiment, the resistor 27 is formed in a deflector layer of thermo-mechanical actuator 15 and participates in the thermo-mechanical effects. Element 80 of the printhead 100 is a mounting structure that provides a mounting surface for microelectronic substrate 10 and other means for interconnecting the liquid supply, electrical signals, and mechanical interface features.

Figure 3A:
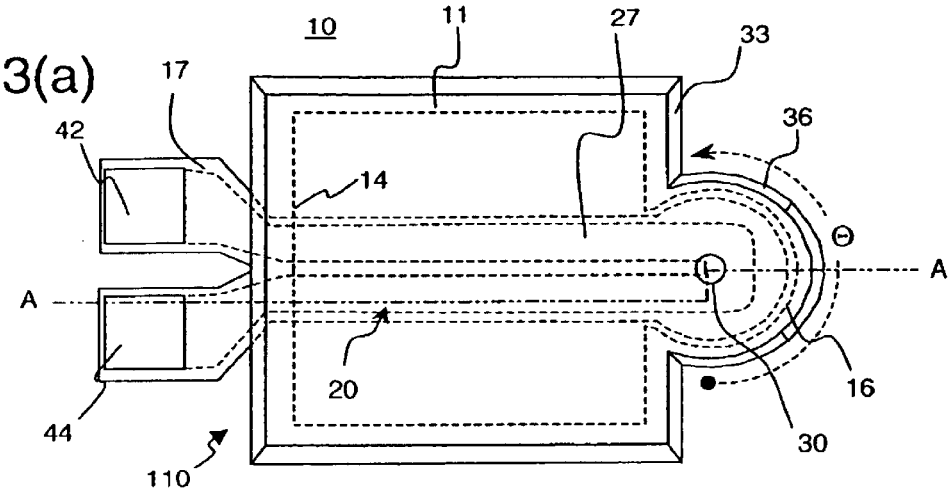
FIGS. 3(*a*) and 3(*b*) are enlarged plan views of an individual ink jet unit illustrated in FIG. 2.
Figure 3B:
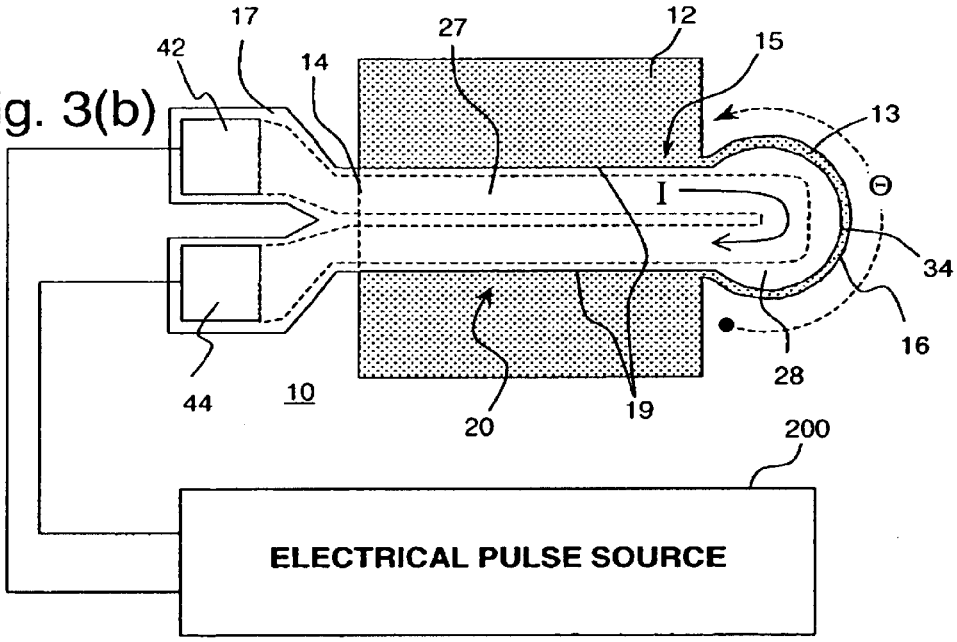

FIG. 3*a* illustrates a plan view of a single drop emitter unit 10 and a second plan view FIG. 3*b* with the liquid chamber structure 33, enclosing the upper ink chamber 11 and including nozzle 30, removed. Upper ink chamber 11 has an arcuate portion 36 that generally surrounds the arcuate free end 28 of the thermo-mechanical actuator 15.

Thermo-mechanical actuator 15, shown in phantom in FIG. 3*a* can be seen with solid lines in FIG. 3*b*. The cantilevered element. 20 of thermo-mechanical actuator 15 extends from edge 14 of lower ink chamber 12 that is formed in substrate 10. Cantilevered element portion 17 is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators that can be used. Many other shapes are applicable. The paddle shape aligns the nozzle 30 with the center of the cantilever free end 28. The lower liquid chamber 12 has a curved wall portion 16 that conforms to the arcuate shaped portion 34 of the actuator free end 28, spaced away to provide a clearance gap 13 for actuator movement. The arcuate portion 34 of free end 28 and the arcuate portions of the upper and lower liquid chambers 36 and 16, are illustrated to extend for an angular amount Θ, wherein Θ is 180 degrees or more. The opposing free edges 19 of the thermo-mechanical actuator, together with free end 28, define an outline of the moveable portion of the thermo-mechanical actuator.

FIG. 3*b* illustrates schematically the attachment of electrical pulse source 200 to the electrically resistive heater 27 at interconnect terminals 42 and 44. Voltage differences are applied to voltage terminals 42 and 44 to cause resistance heating via u-shaped resistor 27. This is generally indicated by an arrow showing a current I. In the plan views of FIG. 3, the actuator free end moves toward the viewer when pulsed and drops are emitted toward the viewer from the nozzle 30 in liquid chamber structure 28. This geometry of actuation and drop emission is called a "roof shooter" in many ink jet disclosures.

Figure 4A:
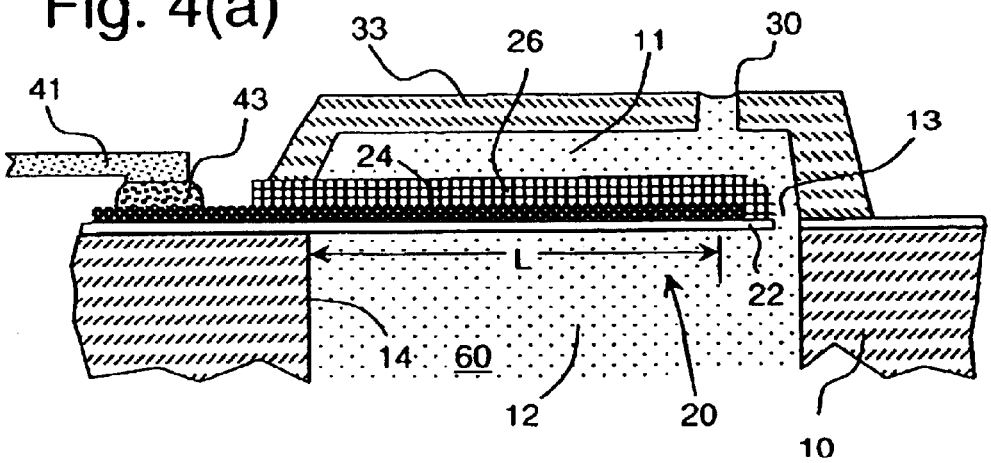
FIGS. 4(*a*)–4(*c*) are side views of an individual ink jet unit as illustrated in FIG. 3(*a*) illustrating the movement of the thermo-mechanical actuator to emit drops.
Figure 4B:
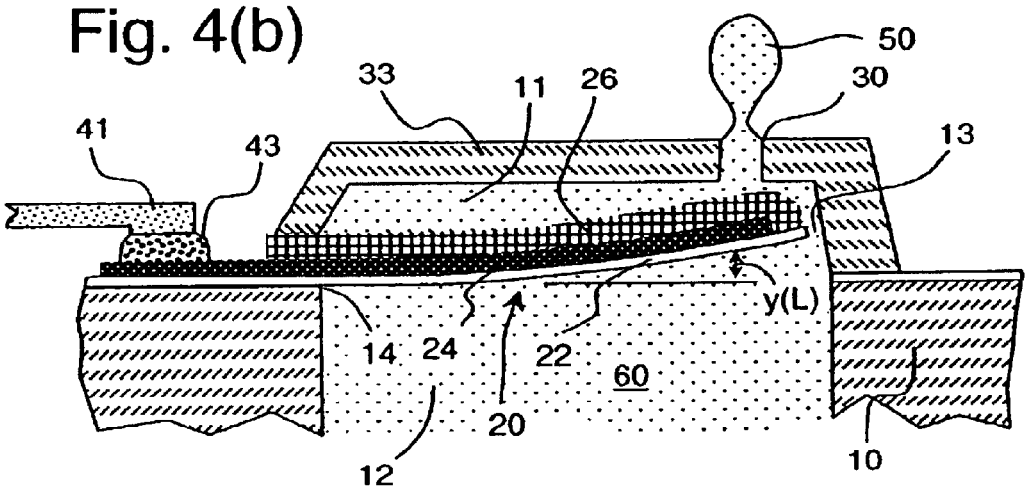
Figure 4C:
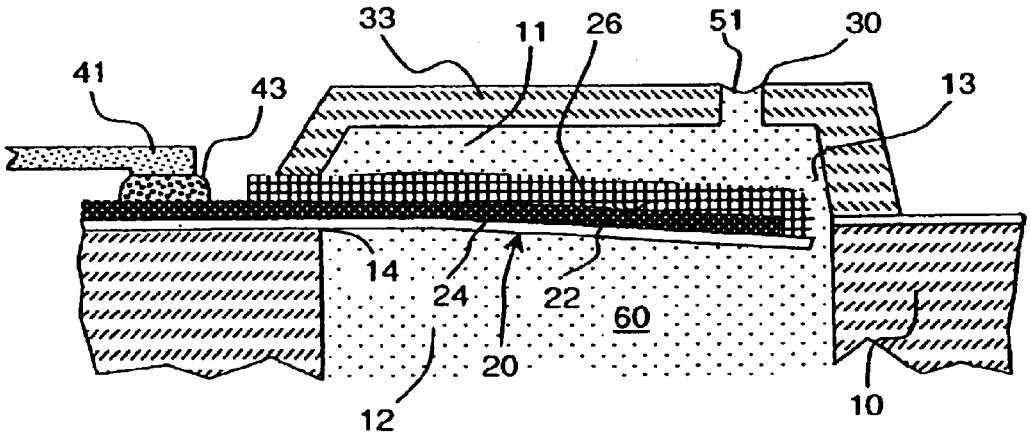

FIG. 4 illustrates in side view a cantilevered element 20 according to a preferred embodiment of the present invention. In FIG. 4*a* the cantilevered element 20 is in a first position and in FIG. 4*b* it is shown deflected upward to a second position. In FIG. 4*c* the cantilevered element is shown in a recoiled, downwardly deflected position. Cantilevered element 20 is anchored to substrate 10 that serves as a base element for the thermo-mechanical actuator. Cantilevered element 20 extends from wall edge 14 of substrate base element 10.

Cantilevered element 20 is constructed of several layers. Layer 24 is the deflector layer that causes the upward deflection when it is thermally elongated with respect to other layers in the cantilevered element. The deflector material is chosen to have a high coefficient of thermal expansion. Further, in the illustrated configuration, the deflector material is electrically resistive and a portion is patterned into a heater resistor for receiving electrical pulses to heat the thermo-mechanical actuator. Electrically resistive materials are generally susceptible to chemical interaction with components or impurities in a working fluid.

Top layer 26 is formed with a top material having a substantially lower coefficient of thermal expansion than the deflector material and has a layer thickness that is on the order of, or larger than, the deflector layer thickness. Top layer 26 in FIG. 4 does not expand as much as the deflector layer when heated thereby constraining the deflector layer from simply elongating and causing the overall cantilevered element 20 to bend upward, away from deflector layer 24. For embodiments wherein the deflector material is electrically resistive and formed with a heater resistor, the top layer material is a dielectric. The top layer material is also chosen to be chemically inert to the working fluid.

Bottom layer 22 is formed of a bottom material that is chemically inert to the working fluid being used with the device, for example, an ink for ink jet printing. It protects the lower surface of the deflector material from chemical interaction. In addition, the bottom material serves as an etch stop during a manufacturing process step described hereinbelow in which substrate material is removed beneath the thermo-mechanical actuator.

The terms "top" and "bottom" are chosen to reference layers with respect to position relative to the substrate. These layers also play a role in determining which direction the deflector layer causes the thermo-mechanical actuator to bend. If both layers were formed of the same materials and of equal thickness, the actuator might not bend at all. The deflector layer will be caused to bend towards whichever layer, top or bottom, is more constraining as a result of its thickness, thermal expansion coefficient and Young's modulus. The biasing of the movement direction is readily achieved by making the layer that is toward the desired direction substantially thicker than the away layer.

When used as actuators in drop emitters the bending response of the cantilevered element 20 must be rapid enough to sufficiently pressurize the liquid at the nozzle. Typically, electrically resistive heating apparatus is adapted to apply heat pulses and electrical pulses with duration of less than 10 $\mu$secs and, preferably, with duration less than 4 $\mu$secs.

In an operating emitter of the cantilevered element type illustrated, the quiescent first position may be a partially bent condition of the cantilevered element 20 rather than the horizontal condition illustrated FIGS. 4*a* and 10*c*. The actuator may be bent upward or downward at room temperature because of internal stresses that remain after one or more microelectronic deposition or curing processes. The device may be operated at an elevated temperature for various purposes, including thermal management design and ink property control. If so, the first position may be substantially bent.

For the purposes of the description of the present inventions herein, the cantilevered element will be said to be quiescent or in its first position when the free end is not significantly changing in deflected position. For ease of understanding, the first position is depicted as horizontal in FIGS. 4*a* and 10*c*. However, operation of thermo-mechanical actuators about a bent first position are known and anticipated by the inventors of the present invention and are fully within the scope of the present inventions.

Figure 5:
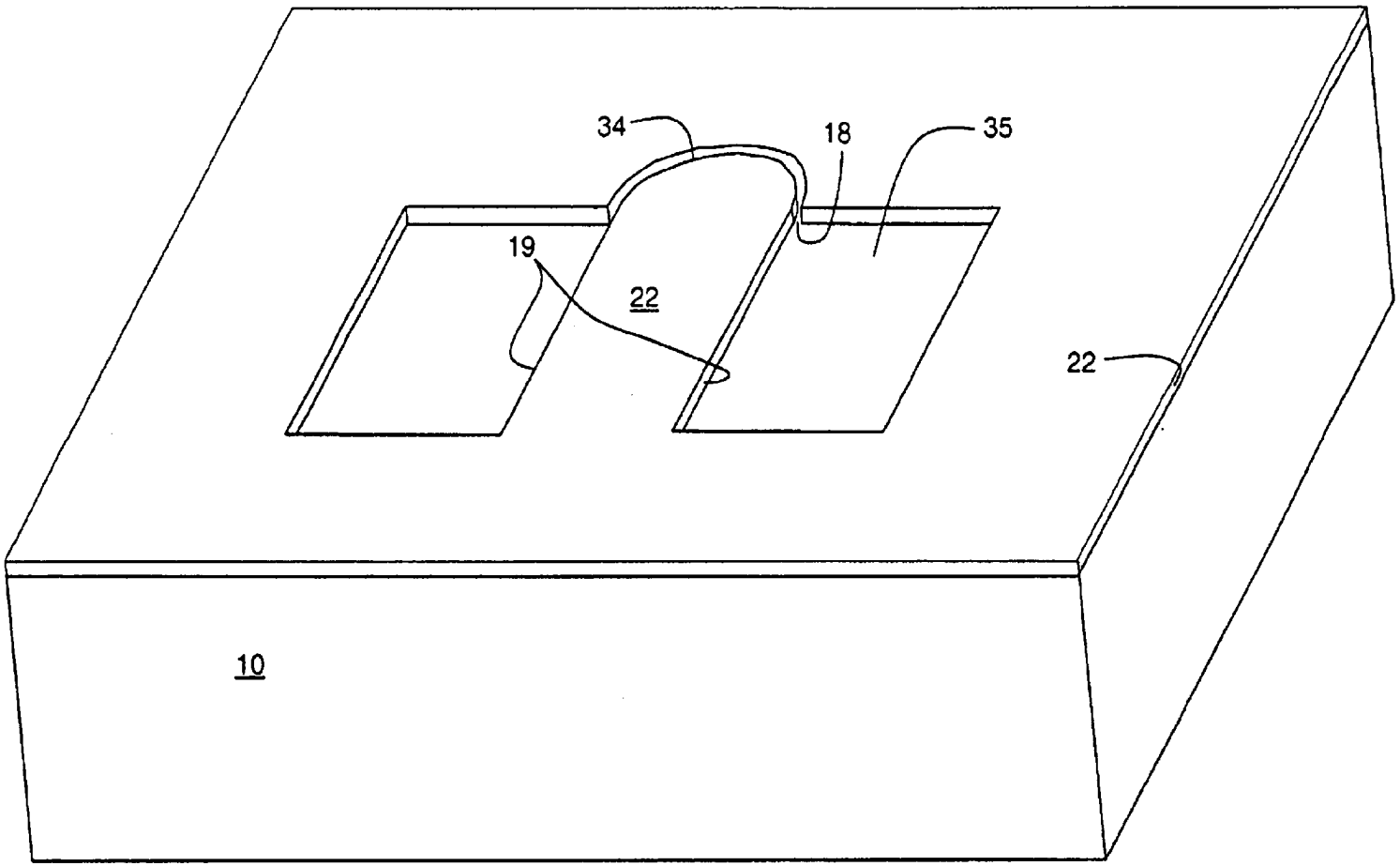
FIG. 5 is a perspective view of a step of the manufacturing method according to the present inventions wherein a bottom layer is formed.

FIGS. 5 through 10(*c*) illustrate methods of manufacturing applied to an ink jet device or other liquid drop emitter having a cantilevered element thermo-mechanical actuator, as illustrated in FIGS. 3 and 4. FIG. 5 illustrates a perspective view of a single cantilevered element at an initial stage of a manufacturing process. Bottom layer 22 has been formed of a bottom material on substrate 10. The bottom material has been removed in a bottom layer pattern so that the substrate is now exposed in some areas. These exposed areas of the substrate will eventually be removed to form portions of the lower liquid chamber 12 and the clearance gap 13 illustrated in FIG. 3*b*. The large rectangular areas of substrate exposure are refill areas 35, which are sized to provide adequate upper chamber refill flow during rapid liquid drop emission, thus allowing a tightly fitting clearance gap 13 to improve drop ejection efficiency without compromising refill. The moveable portion of the bottom layer 22 has opposing free edges 19. The substrate 10 is also exposed in free edge area 18 adjacent the arcuate edge 34 of the free end.

The bottom material for the cantilevered element thermo-mechanical actuator is deposited as a thin layer so to minimize its impedance of the upward deflection of the finished actuator. A chemically inert, pinhole free material is preferred so as to provide chemical and electrical protection of the deflector material that will be formed on the bottom layer. A preferred method of the present inventions is to use silicon wafer as the substrate material and then a wet oxidation process to grow a thin layer of silicon dioxide. Alternatively, a high temperature chemical vapor deposition of a silicon oxide, nitride or carbon film may be used to form a thin, pinhole free dielectric layer with properties that are chemically inert to the working fluid.

Figure 6:
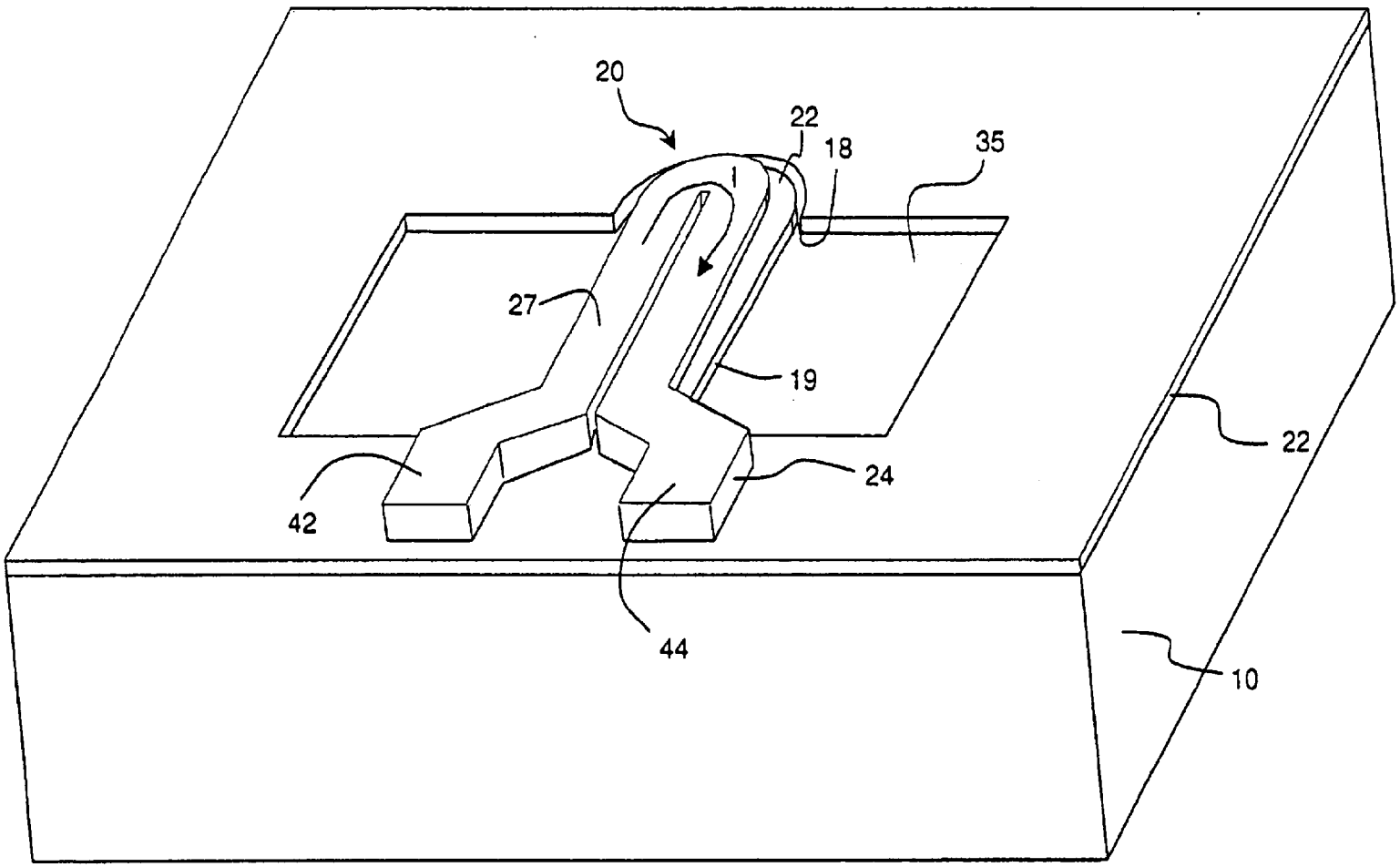
FIG. 6 is a perspective view of a step of the manufacturing method according to the present inventions wherein a deflector layer is formed.

FIG. 6 illustrates the addition of a deflector layer 24 over the previously deposited bottom layer. Deflector material is removed in a deflector layer pattern. In the illustrated configuration, the deflector layer is comprised of an electrically resistive deflector material, a portion of which is patterned into a u-shaped heater resister 27 which can be addressed by input leads 42 and 44. Deflector material is removed so that it does not overlap the bottom layer material. In the design illustrated in FIG. 6, the deflector material is removed well back from edges 19 of bottom layer 22. Alternatively, the deflector layer and the bottom layer could be patterned together using the bottom layer pattern so that both layers coincided at free edges 19. A subsequent patterning of the deflector layer only would then be needed to introduce any unique features such as the resistor and addressing leads.

The deflector material is selected to have a high coefficient of thermal expansion, for example, a metal. In addition, for the examples illustrated herein, the deflector material is electrically resistive and used to form a heater resistor. Nichrome (NiCr) is a well known material that could be used as a deflector material. A 60% copper, 40% nickel alloy, cupronickel, and titanium nitride are disclosed in K. Silverbrook U.S. Pat. Nos. 6,254,793 and 6,274,056.

An especially efficient and preferred bending material is intermetallic titanium aluminide (TiAl), disclosed in co-pending U.S. patent application Ser. No. 09/726,945 filed Nov. 30, 2000, for "Thermal Actuator", assigned to the assignee of the present invention. TiAl material may be formed by RF or DC magnetron sputtering in argon gas. It has been found that desirable TiAl films are predominantly disordered face-centered cubic (fcc) in crystalline structure and have a stoichiometry of $Al_{4-x}Ti_x$, where $0.6 \leqq x \leqq 1.4$. Titanium aluminide may be pattern etched with a standard chlorine-based dry etching system commonly used in microelectronic device fabrication for aluminum etching.

If the resistivity of the deflector material is in an appropriate range, then a portion of the deflector layer can be patterned as a resistor and used to introduce heat pulses to the thermo-mechanical actuator. Alternatively, a separate electrical resistor layer can be added or heat energy can be coupled to the actuator by other means such as light energy or inductively coupled electrical energy. The titanium aluminide material preferred in the present inventions has a resistivity of ~160 $\mu$ohm-cm, which is a reasonable resistivity for a heater resistor that could be driven by integrated circuit transistors. Typical thicknesses, $h_d$, for the deflector layer are 0.5 $\mu$m to 2 $\mu$m.

Figure 7:
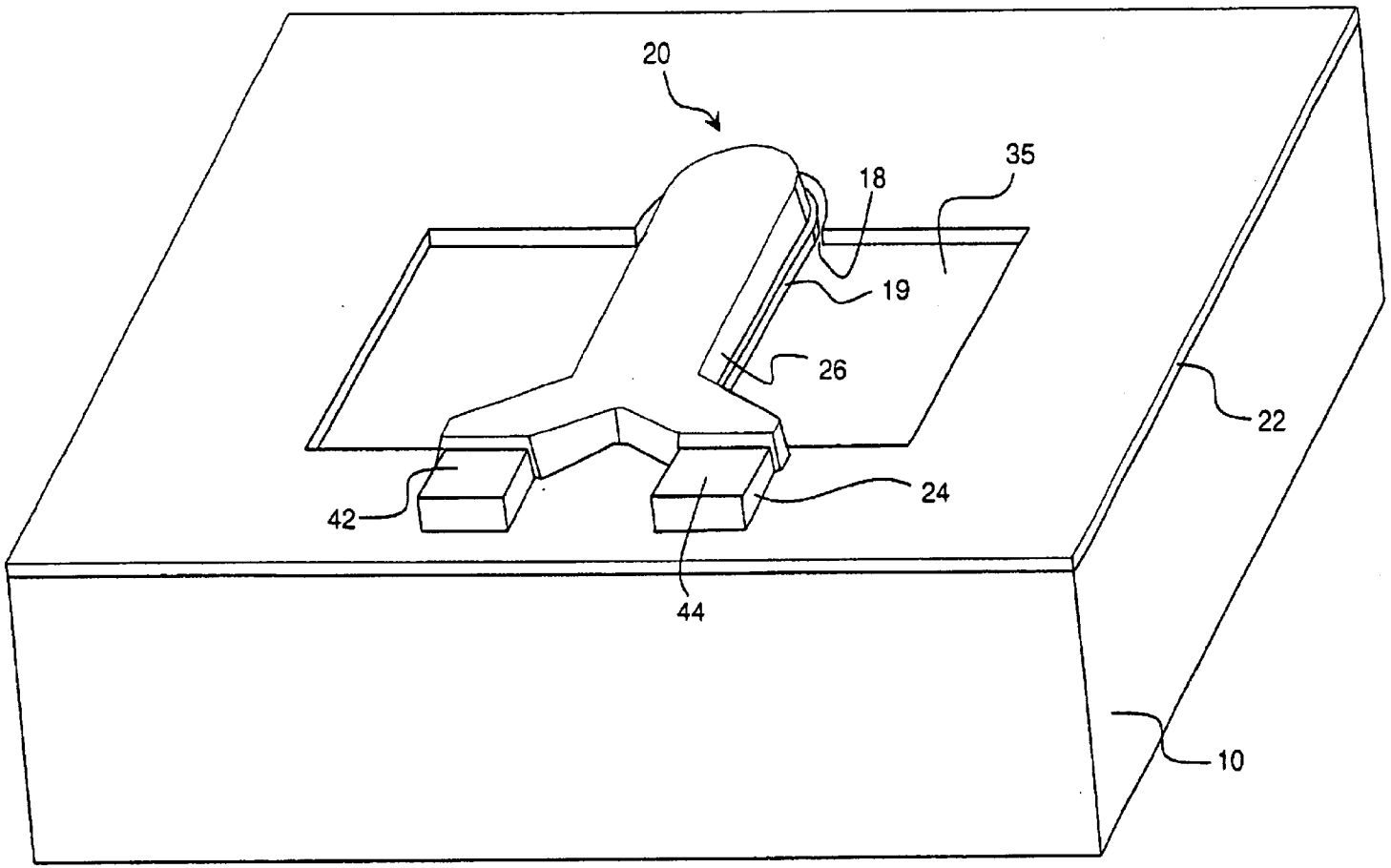
FIG. 7 is a perspective view of a step of the manufacturing method according to the present inventions wherein a top layer is formed.

FIG. 7 illustrates in perspective view the addition of a top layer 26 formed over the deflector layer 24, bottom layer 22, and substrate 10. The top layer 26 is removed in a top layer pattern that generally leaves top layer material covering the deflector material in the moveable area of the cantilevered element. The top layer as illustrated in FIG. 7 performs two main functions, it protects the deflector material from chemical interaction with the working fluid, and it biases the deflection of cantilevered element 20 towards itself.

A typical dielectric material used for the top material is silicon dioxide or silicon nitride. Many other dielectrics may be used. In the configuration of FIG. 7 wherein the top layer is relatively thick, oxides and nitrides deposited by low temperature CVD processes will provide substantial chemical interaction protection for the deflector layer. The top layer pattern leaves top material covering the free edges of the deflector layer so as to provide chemical and electrical passivation. Further, the top material free edges may underlap, overlap or be coincident with bottom layer free edges 19. An underlapping condition is illustrated in FIG. 7. If the top material is allowed to overlap the bottom material into free edge area 18 on substrate 10, it cannot be allowed to completely cover free edge area 18. Some portion of free edge area 18 adjacent the arcuate free edge 34 of the free end 28 of cantilevered element 20 must remain so that a subsequent process step of removing the substrate beneath free edge area 18 is effective in releasing the moveable portion of the cantilevered clement 20 from attachment to the substrate.

The patterning of top layer 26 completes the construction of the cantilevered element 20 for the liquid drop emitter 110 being discussed. Other layers may be added for other purposes, for example a separate layer and insulator to form a resistive heater, instead of using the deflector material for this function. Also, the top, deflector and bottom layers may be comprised of sub-layers or layers with graded material properties. Such additional layers and features are known and comprehended by the inventors as being within the scope of the methods of manufacture of the present inventions.

Figure 8:
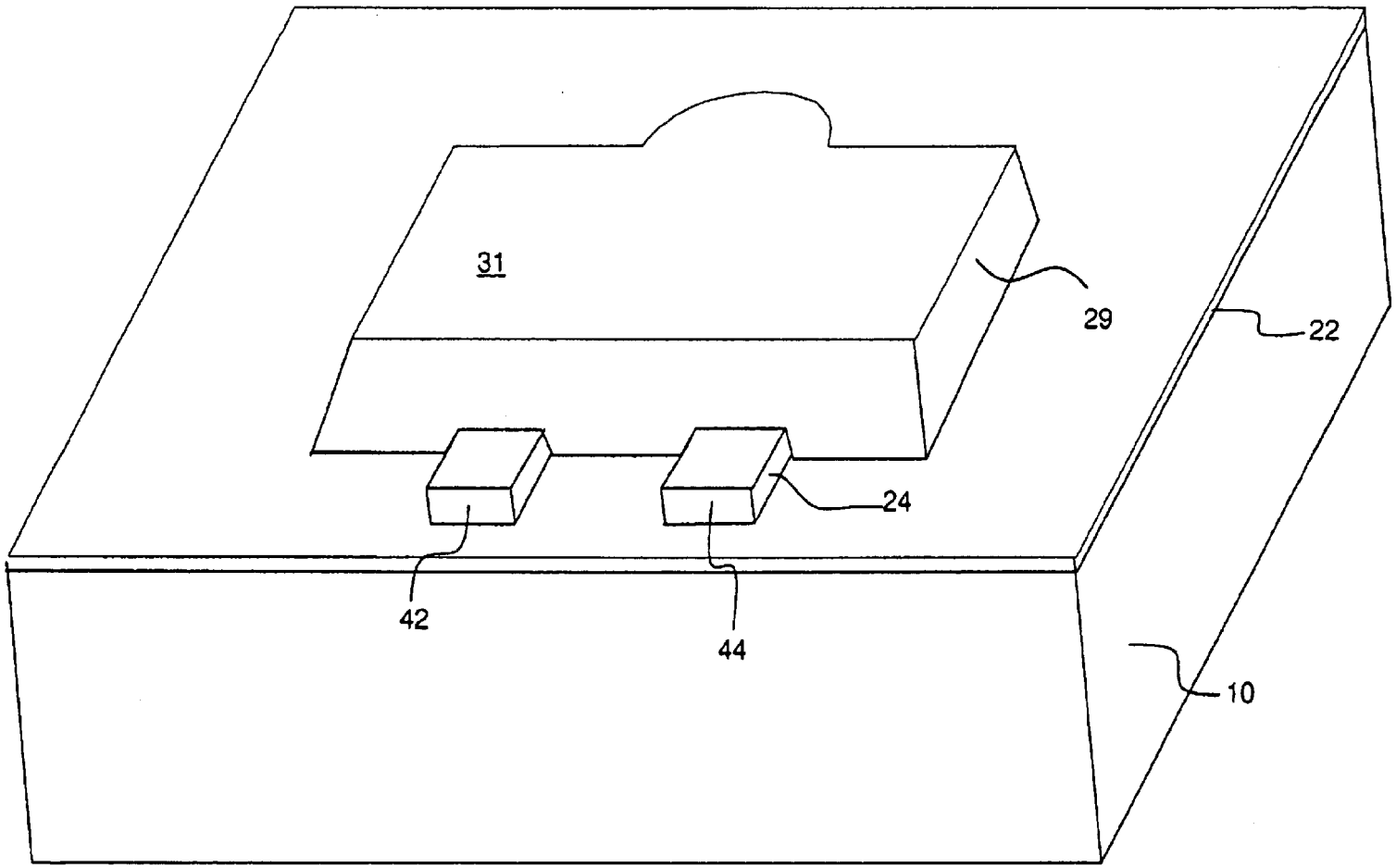
FIG. 8 is a perspective view of a step of the manufacturing method according to the present inventions wherein a sacrificial layer is formed.

FIG. 8 shows the addition of a sacrificial layer 29 formed of a sacrificial material and removed in a sacrificial layer pattern. The sacrificial layer pattern leaves the sacrificial material formed into the shape of the interior of an upper liquid chamber 11 of a liquid drop emitter. For a generalized liquid control device concept, this chamber space can be understood as a movement volume for the thermo-mechanical actuator. By movement volume it is meant the space into which the moveable portion of the thermo-mechanical actuator can travel freely without being impeded by structural elements.

The sacrificial material is intended as a temporary form whose outer surface shape will become the inner surface shape of the structure layer that is to be next added. In addition the sacrificial material must be able to fully conform to the underlying layered structure of the cantilevered element including making good contact with the free edge area 18 on substrate 10.

Any material that can be selectively removed with respect to the adjacent materials, fully conforms to the underlying topography down to the free edge area 18, and remains smooth and planar after patterning and curing is a candidate for constructing sacrificial layer 29.

Figure 9:
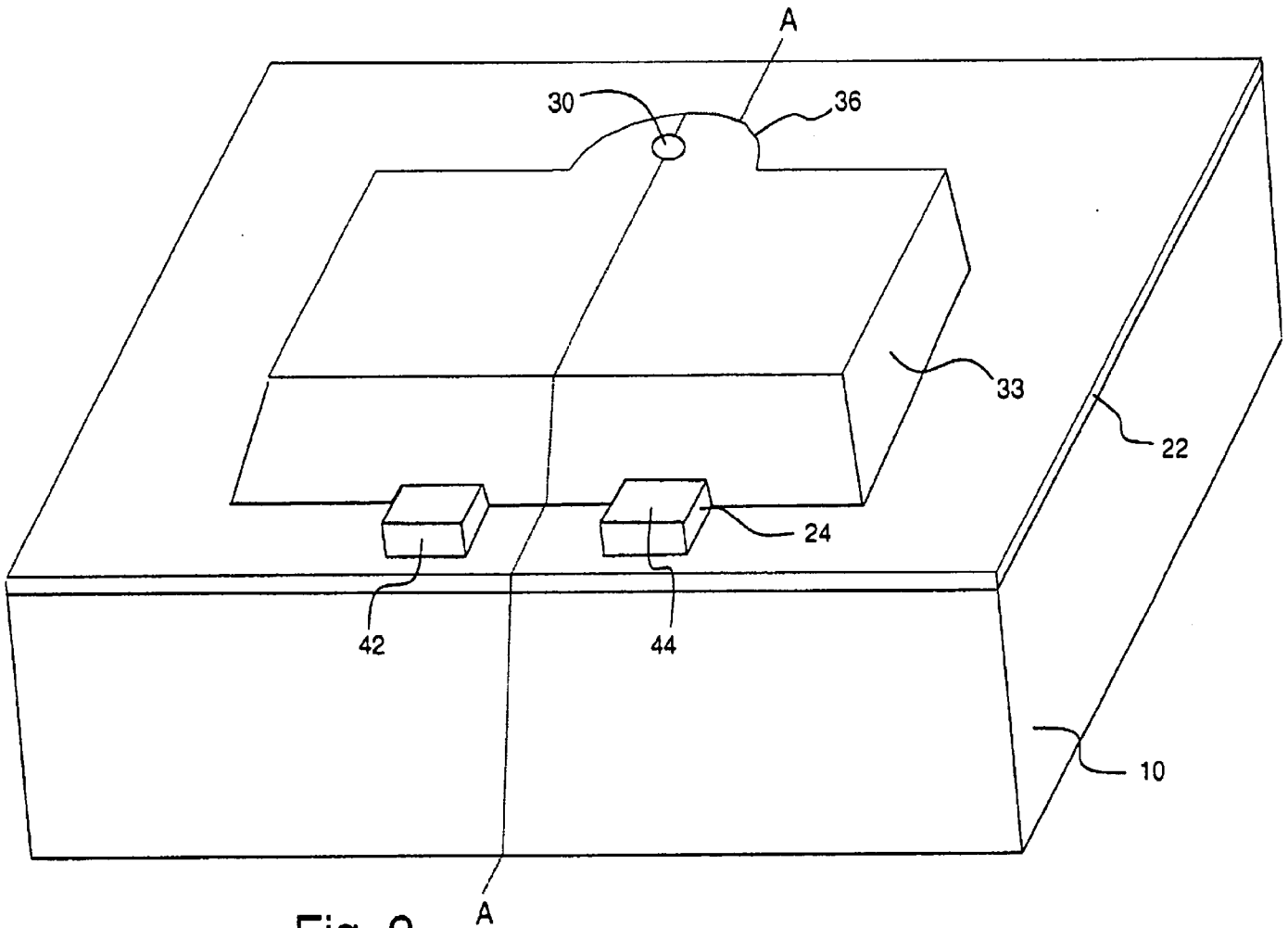
FIG. 9 is a perspective view of a step of the manufacturing method according to the present inventions wherein a structure layer is formed.

FIG. 9 illustrates a patterned structure layer 33 formed by a structure material deposited over the sacrificial layer and other exposed layers on the substrate. Structure material is then removed according to a structure layer pattern resulting in the drop emitter liquid chamber 33 with walls, cover and nozzle 30, and arcuate wall portion 36 illustrated in FIG. 9. In generic liquid control device terms, the patterned structure layer 33 contains a movement volume 11 and provides a structure opening 30 that communicates with the sacrificial material still occupying the movement volume space. Electrical leads 42 and 44 are exposed for electrical attachment to an electrical pulse source.

Suitable structure materials include plasma deposited silicon oxides or nitrides. The structure material must conform to the rather deep topography of the completed sacrificial layer 29. The sacrificial layer ranges in height above the substrate from ~1 μm in the area around electrical leads 42, 44 up to 5 μm–15 μm at the upper surface 31 of the movement volume 11 (see FIG. 8). The structure material must also be chemically inert to the working fluid and mechanically strong and durable enough to withstand drop ejection pressure pulses and some mechanical wiping for printhead maintenance purposes.

Figure 10:
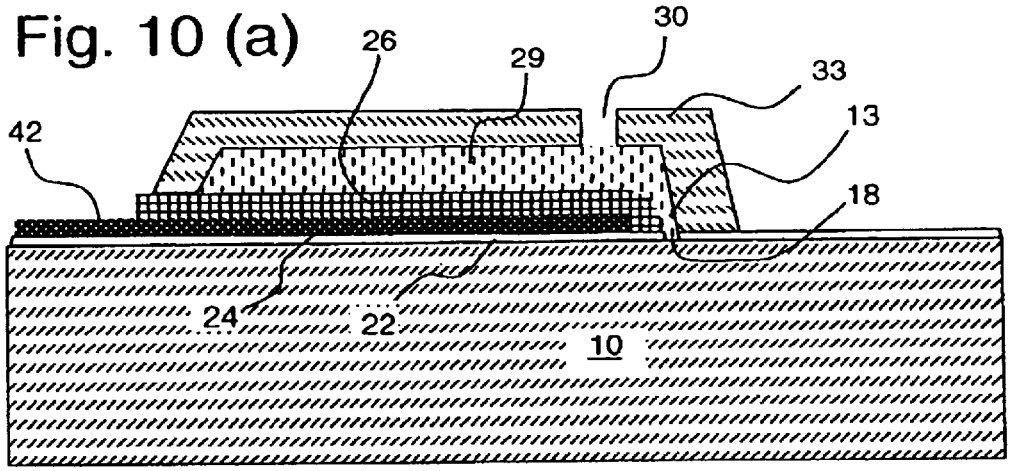
FIGS. 10(*a*)–10(*c*) are side views of final stages of the manufacturing method according to the present inventions wherein a liquid chamber is created by removing sacrificial material, and the thermo-mechanical actuator is released and the fluid pathway completed by removing substrate material beneath the moveable and free edge areas.

FIGS. 10(*a*)–10(*c*) show side views of the device through a section indicated as A—A in FIG. 9. In FIG. 10*a* the sacrificial layer 29 is enclosed within the drop emitter chamber walls 33 except for nozzle opening 30. Also illustrated in FIG. 10*a*, the substrate 10 is intact. The substrate is covered by sacrificial material in gap area 13 immediately above free edge area 18 adjacent the free edges of the cantilevered element. For the configuration illustrated in FIG. 10, the most outer edge of the moveable portion of the cantilevered element aligns with the free edges 19 and 34 of bottom layer 22 as illustrated in FIGS. 5–7.

Figure 10B:
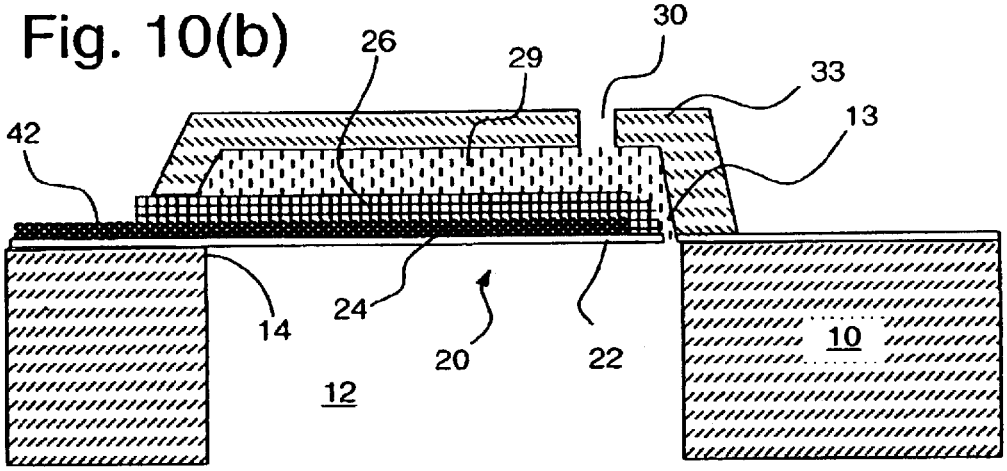
Figure 10:
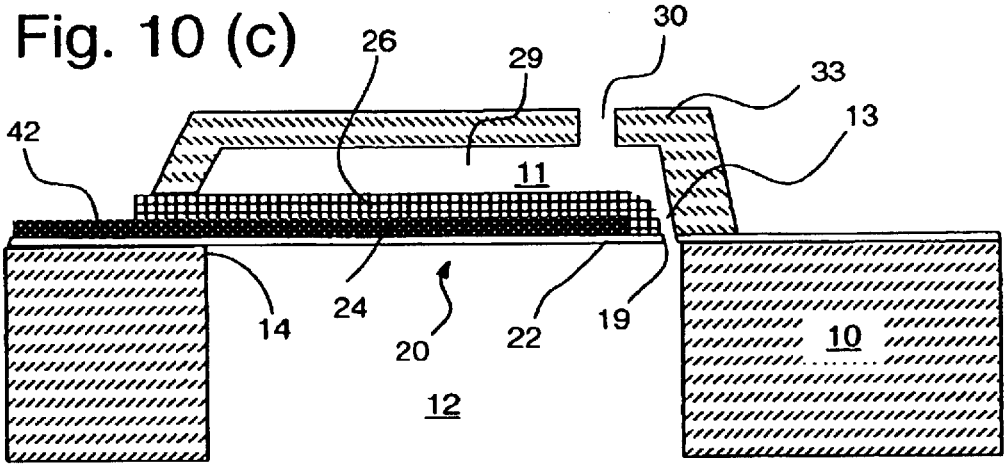

In FIG. 10*b*, substrate 10 is removed beneath the cantilevered element 20, the liquid chamber areas around and beside the cantilevered element 20 and the free edge area 18. This removal may be accomplished by an anisotropic etching process such as reactive ion etching for the case where the substrate used is single crystal silicon. For constructing a thermo-mechanical actuator alone, the sacrificial structure and liquid chamber steps are not needed and this step of etching away substrate 10 may be used to release cantilevered element 20 from attachment to substrate 10.

Removal of the substrate material, in addition to releasing the moveable portion of the thermo-mechanical actuator, opens a pathway for liquid to enter the liquid emission device from the substrate. At the fabrication stage illustrated in FIG. 10*b*, liquid entering from lower liquid chamber volume 12 may touch the bottom layer 22 of the cantilevered element 20, the sacrificial material in gap area 13, and the sacrificial material in the large refill areas 35 (see FIGS. 5–7) flanking the cantilevered element, not visible in this A—A cross sectional view lengthwise through the cantilevered element. The refill areas are sized to provide rapid refill of upper liquid chamber 11 following drop ejection for liquid drop emitter devices.

In FIG. 10*c* the sacrificial material layer 29 has been removed using a penetrating process such as dry etching using oxygen and fluorine sources. The etchant gasses enter via the nozzle 30 and from the newly opened fluid supply chamber area 12, etched previously from the backside of substrate 10. This step removes the sacrificial material from the movement volume of the device, allowing the cantilevered element 20 to move freely and completes the fabrication of a liquid drop emitter structure.

The process steps of removing the substrate material and removing the sacrificial material illustrated in FIG. 10 may be performed in either order. It may be beneficial to remove the substrate material and then singulate individual devices leaving the sacrificial material intact to protect the movable portion of the thermo-mechanical actuator and prevent particles from entering the movement volume. A drop emitter device may be mechanically mounted, and interconnected electrically and fluidically with a protective filter, in a less clean environment if the sacrificial material is left inside the device until a later, final step in the overall manufacturing workflow. However, it is also feasible to remove the sacrificial material first when the substrate is still whole. This process latter order offers the productivity advantage of performing the sacrificial material etch on a wafer level set of devices, instead of individually.

FIGS. 5 through 10*c* illustrate a preferred fabrication sequence. However, many other construction approaches may be followed using well known microelectronic fabrication processes and materials. For the purposes of the present invention, any fabrication approach which results in a cantilevered element including a deflector layer 24 and a top layer 26 may be followed. Further, in the illustrated sequence of FIGS. 5 through 10*c*, the liquid chamber 33 and nozzle 30 of a liquid drop emitter were formed in situ on substrate 10. Alternatively a thermo-mechanical actuator could be constructed separately and bonded to a liquid chamber component to form a liquid drop emitter.

It has been discovered by the inventors of the present inventions that the volume or size of the liquid drops emitted by a thermo-mechanically actuated liquid drop emitter may be varied by changing the parameters of the heat pulses applied to the actuator. Returning to FIGS. 3 and 4, it may be understood that when an appropriate rapid heat pulse is applied to the cantilevered element 20, the free end 28 is caused to move rapidly towards nozzle 30, accelerating a fluid volume generally having the area of the free end 28 times the amount of free end displacement, y(L). The volume of liquid emitted is roughly proportional to the amount of fluid displaced by the moving cantilevered element.

The free end 28 of cantilevered element 20 is deflected an amount y(L) by thermo-mechanical expansion effects in the various layers, caused by raising the temperature of one or more layers an amount ΔT above ambient. That is, a simple first order equilibrium analysis will show that:

$$y(L)=c\Delta TL^2/2, \tag{1}$$

where c is a thermo-mechanical structure factor which depends on the Young's modulus, the coefficient of thermal expansion, the thickness, and the Poisson's ratio of each of the layers of the cantilevered element which is heated. It is not necessary to examine the details of the somewhat complex thermo-mechanical structure factor to understand the present inventions. The quantity (cΔT) in Equation 1 is termed the thermal moment of the multi-layered structure.

The temperature of the thermo-mechanical actuator is raised by a heat pulse of energy E, applied at a power level P for a pulse time duration $\tau_p$.

$$E=P\tau_p. \tag{2}$$

To first order, the temperature rise, ΔT, is then:

$$\Delta T = \frac{E}{m_{eff}C_{eff}} = \frac{P\tau_p}{m_{eff}C_{eff}}, \tag{3}$$

where $m_{eff}$ is the effective mass and $C_{eff}$ is the effective heat capacity of the heated portion of the thermo-mechanical actuator.

Thus, a first order equilibrium analysis of the relationship between the deflection of the free end 28 of the cantilevered element, which largely determines emitted drop volume, yields the following:

$$y(L) = \left(\frac{cL^2}{2m_{eff}C_{eff}}\right)E = \left(\frac{cL^2}{2m_{eff}C_{eff}}\right)P\tau_p. \tag{4}$$

From Equation 4, the emitted drop volume may be anticipated to increase proportionately to an increase in applied energy E. If a constant input power, $P_0$, is utilized, then Equation 4 also implies that the drop volume will increase proportionately to an increase in pulse time duration $\tau_p$.

Figure 11:
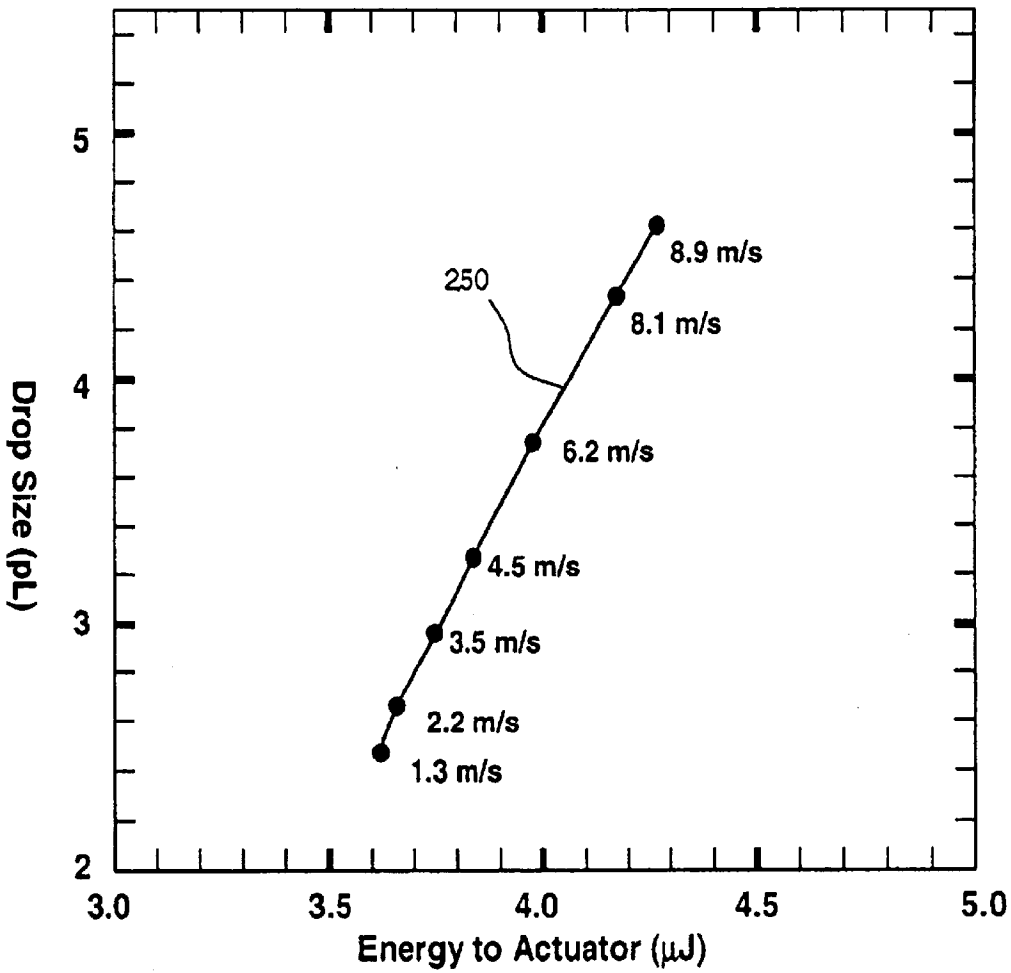
FIG. 11 reports experimental data showing the relationship of drop volume, drop velocity and input heat energy for a constant heat pulse duration.

FIG. 11 shows experimental data 250 for drop volume emitted as a function of applied input energy using a constant pulse time duration, $\tau_p$=2 μsec. The data plotted in FIG. 11 were collected for a representative drop emitter filled with water and configured as illustrated in FIGS. 3 and 4. The cantilevered element 20 length L was 90 μm, the width of the rectangular portion of the cantilever and the diameter of the semi-circular free end 28 were both 30 μm. The nozzle 30 diameter was 14 μm. The resistance of a heater resistor 27 formed in a deflector layer 24 was 26 ohms. Individual data points are marked by dots along plot 250. Individual data points are also labeled with the drop velocity observed for each drop volume.

It may be seen from FIG. 11 that over a certain input energy range, ~3.6 μJ–4.3 μJ, the emitted drop volume is approximately proportional to the input energy. The drop velocity also varied in this experiment from a low of ~1.3 meters/sec., up to 8.9 m/sec. Drop emission exhibits a threshold effect in that no drops are emitted until a certain threshold is reached, approximately 3.6 μJ for the experimental conditions reported in FIG. 11. The large amount of threshold energy is needed to overcome the effects of compliance in the drop emitter structure and to overcome fluid mechanical forces arising from surface tension and fluid viscosity, which resist the formation of a liquid jet at the nozzle.

An upper limit on the amount of input energy that may be usefully applied is imposed by certain high temperature failure modes. It was found that for larger input energies than the 4.6 μJ point plotted in FIG. 11 still larger volume drops were emitted but at erratic drop velocities. Vapor bubble formation was observed near the hottest locations on the thermo-mechanical actuator for these larger input energy pulses, E>4.6 μJ. Vapor bubble formation and collapse is undesirable because it introduces unpredictable pressure impulses or may cause cavitation damage to the thermo-mechanical actuator or a build-up of kogated ink materials.

Many applications of liquid drop emitters, for example ink jet printing, fire drops across a spacing gap distance, $G_p$, to a predetermined receiver location, i.e. a pixel location in a raster image. In addition, for many of these applications, the liquid drop emitter and the receiver are moved with respect to each other by a carriage mechanism at a relative velocity, $v_c$, so that drops may be deposited at different locations in a time efficient fashion. A predictable drop velocity, $v_{d0}$, is therefore necessary in order to direct drops to the intended location. If the drop velocity varies, then the flying time from the nozzle to the receiver plane, $G_p/v_{d0}$, will vary. If the flying time varies, then the distance traveled in the direction of the relative motion, $d_c$, will also vary accordingly:

$$d_c = G_p\frac{v_c}{v_{d0}}. \tag{5}$$

Some amount of variation in $d_c$, i.e. some drop placement error relative to predetermined locations such as image pixel rasters, due to drop velocity variation, may be tolerable depending on the specific system application of the drop emitter. In ink jet printing such drop placement errors may affect the perceived sharpness of image edges or cause undesirable streaks or image density artifacts. A larger level of drop placement error may be tolerable for the printing of certain images, such as text and line graphics only, than is acceptable for printing an image having grayscale. Methods of operating a liquid drop emitter that emits drops at different velocities will be further discussed hereinbelow.

Drop placement errors, for drops having different volumes due to drop velocity variations, may be avoided by using methods of operating liquid drop emitters that achieve a substantially uniform drop velocity. It has been found by the inventors of the present inventions that the drop velocity of emitted drops having different volumes may be made substantially constant by adjusting both the time duration of the heat pulse, $\tau_p$, and the applied power, P, to achieve different amounts of pulse energy input, E.

Figure 12:
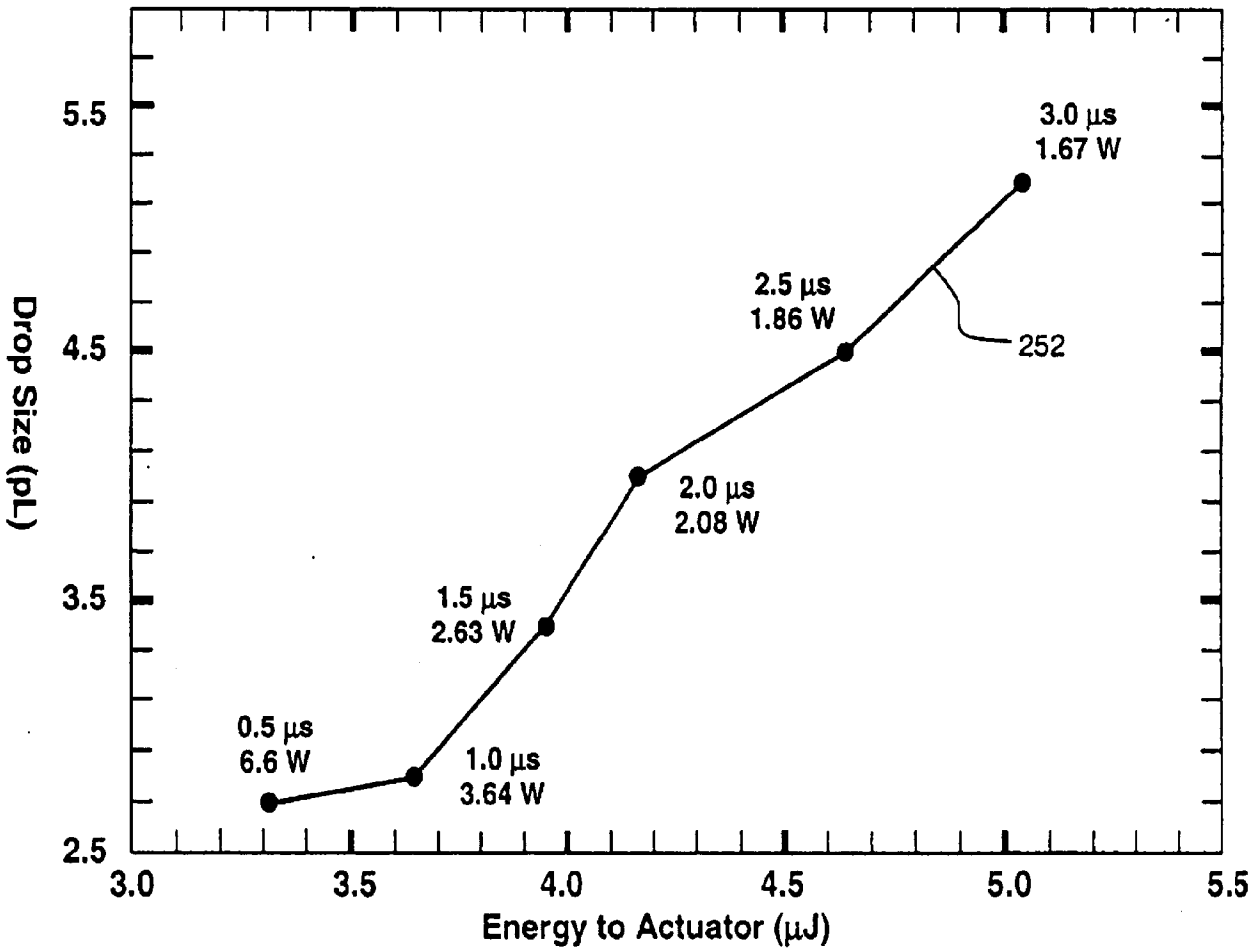
FIG. 12 reports experimental data showing the relationship of drop volume, input heat energy and heat pulse duration for drops having substantially the same velocity.

FIG. 12 shows experimental data 252 for drop volume emitted as a function of input energy applied using a pulse time duration $\tau_p$ and input power P adjusted to achieve a substantially constant drop velocity of 8 m/sec. The data plotted in FIG. 12 were collected for a representative drop emitter filled with water and configured as illustrated in FIGS. 3 and 4. The drop emitter used was similar to that used for the data reported in FIG. 11. The cantilevered element 20 length L was 90 $\mu$m; the width of the rectangular portion of the cantilever and the diameter of the semi-circular free end 28 both 30 $\mu$m; the nozzle 30 diameter was 14 $\mu$m; and the resistance of a heater resistor 27 formed in a deflector layer 24 was 26 ohms. Individual data points are marked by dots along plot 252. Individual data points are also labeled with the applied heat pulse duration $\tau_p$ in microseconds ($\mu$s) and the applied power P in watts (W).

The experimental data reported in FIG. 12, as well as other data collected by the inventors of the present inventions, show that it is necessary to adjust the input power, as well as the total input energy, in order to achieve a specific target drop velocity, $v_{d0}$, when generating drops having substantially different volumes. It has been found experimentally that the power P must be reduced while lengthening the time duration of the heat pulse, $\tau_p$, to a longer value, in order to achieve a desired drop volume increase, otherwise, the drop velocity will also increase. In addition, a threshold energy for the emission of a smallest drop is observed. The smallest volume drop that could be emitted at 8 m/sec in the experiments reported in FIG. 12 was a 2.6 pL drop emitted by the application of 3.3 $\mu$J of energy.

Some preferred methods of operating a liquid drop emitter having a thermo-mechanical actuator according to the present inventions are to cause the emission of drops having substantially different volumes while having substantially the same velocity. The term "substantially different volumes", when used herein, means that the range of drop volumes emitted is at least 20%, that is, that the largest drop emitted has at least 20% more volume than the smallest drop emitted. The term "substantially the same velocity", when used herein, means that the range of drop velocities is less that 20%, that is, that the fastest drop emitted is no more than 20% faster than the slowest drop emitted. These preferred methods of operation are accomplished by selecting, for each drop volume to be emitted, appropriate heat pulse parameters including the total energy, power and pulse time duration. Higher values of the total input heat energy E are selected to emit larger drops. Lower values of the power P together with longer pulse time duration values $\tau_p$ are also selected to emit larger drops at substantially the same velocity.

The practice of the methods of operating liquid drop emitters according to the present inventions is preferably combined with certain features of the liquid drop emitter apparatus. Firstly, it is believed that the range of drop volumes accessible by changing the energy, power and pulse time duration values is enhanced if the thermo-mechanical actuator is configured as a cantilevered element having an arcuate free end that moves within a closely-spaced, surrounding, arcuate liquid chamber portion. This preferred configuration is generally illustrated by the plan views in FIGS. 3*a* and 3*b*. For such a configuration the movement of the free end 28 translates efficiently into moving the fluid behind the nozzle.

Leakage of fluid around the free end 28 via the clearance distance 13 represents a loss of energy efficiency by weakening the direct proportionality between the amount of free end deflection and the volume of fluid that is moved toward the nozzle to form a jet. An arcuate shape minimizes the perimeter to area ratio of the free end, hence minimizes the length of the fluid leakage path around the free end. It has been found by the inventors of the present inventions that an arc of 180 degrees or more is preferable to minimize energy losses. Generally conforming the stationary arcuate portions of the upper and lower liquid chambers to the arcuate shape of the free end edge, and minimizing the clearance distance therebetween further reduces the leakage path. It has been found by the inventors of the present inventions that it is preferable to form as small a clearance distance as is reliably possible and preferably less than 3 microns.

Secondly, a cantilevered element thermo-mechanical actuator will exhibit a damped resonant oscillation following an initial thermal excitation pulse. Referring to FIGS. 4*a*–4*c*, cantilevered element 20 will quickly relax from the bent position illustrated in FIG. 4*b* as elements 24 and 26 equilibrate in temperature, as heat is transferred to the working fluid and substrate 10, and due to mechanical restoring forces set up in elements 24 and 26. The relaxing cantilevered clement 20 will over shoot the quiescent state, FIG. 4*a*, and bend downwards as illustrated in FIG. 4*c*. Cantilevered element 20 will continue to "ring" in a resonant oscillatory motion until damping mechanisms, such as internal friction and working fluid resistance, deplete and convert all residual mechanical energy to heat.

If predictable drop volume and velocities are important for the application, the damped resonant oscillation effects described above must be considered in designing the operating method. Directing drop emissions at arbitrary times during the resonant oscillations may cause intended drop volumes and intended drop velocities to vary unacceptably. The present inventive methods of operating a liquid drop emitter preferably are carried out so as to avoid complications arising from intrinsic damped resonant oscillations of the cantilevered element. This is accomplished by selecting all pulse time duration values to be less than one-quarter cycle of the period of the fundamental resonant mode, $\tau_R$.

Figure 13:
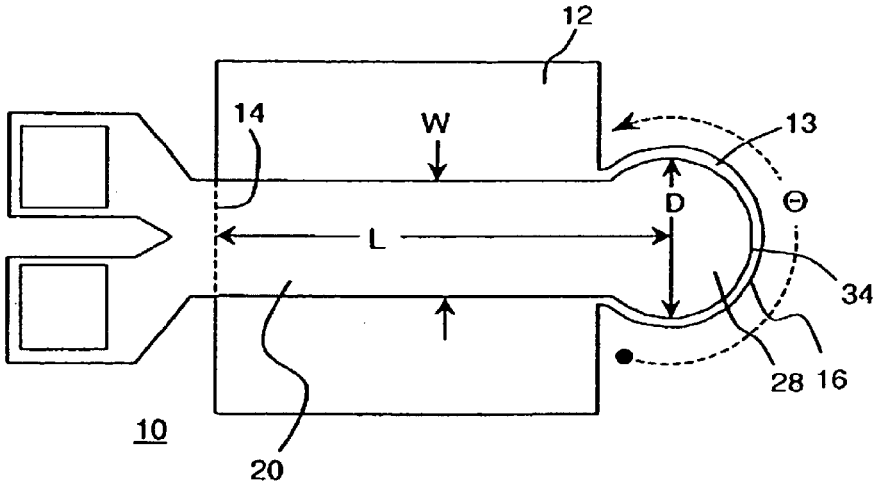
FIG. 13 illustrates geometrical parameters important to the resonant oscillation behavior of a cantilevered thermo-mechanical actuator and reports experimental results for the fundamental resonant periods and damping time constants for several experimental thermo-mechanical actuator configurations.
Figure 14:
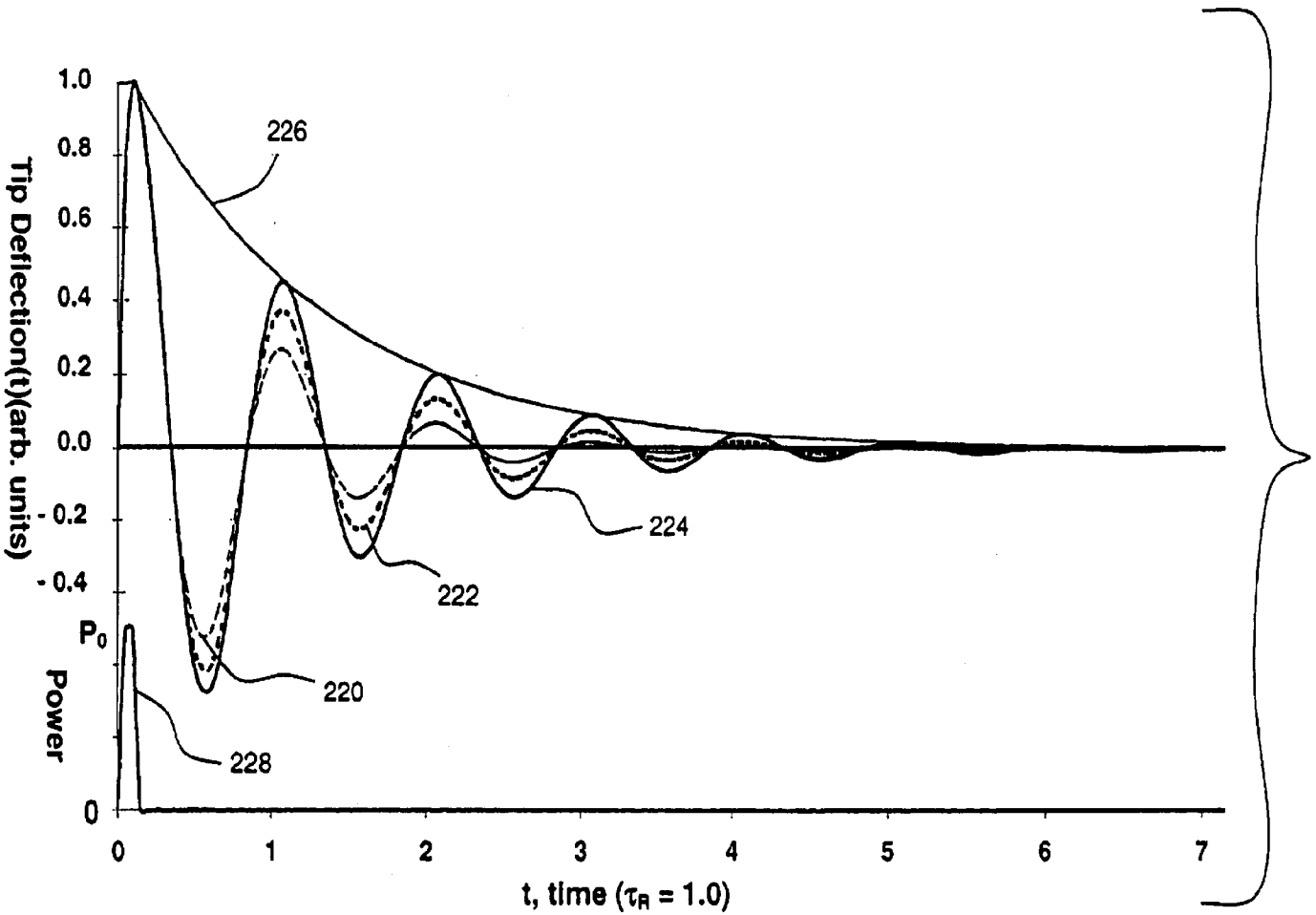
FIG. 14 illustrates damped resonant oscillation of a thermo-mechanical actuator according to the present inventions.

FIGS. 13 and 14 illustrate damped resonant oscillation of the free end 28 of a cantilever element 20 moving in fundamental mode. FIG. 13 discloses experimental data for several parameter variations of the general thermo-mechanical actuator configuration illustrated in FIGS. 3*a*–4*c*. The table in FIG. 13 discloses the observed fundamental resonant frequency, F, the period of the fundamental resonance, $\tau_R$, and the damping time constant, $\tau_D$, for several different configurations of the cantilevered element length, L, width, W, and free end diameter, D. The damped resonant behavior disclosed was measured with water as the working fluid.

Free end displacement, y(L,t), is plotted in FIG. 14 as a function of time, t, according to Equation 6:

$$y(L,t)=\sin(2\pi t/\tau_R)\exp(-t/\tau_D). \quad (6)$$

where $\tau_R$ is the period of the fundamental resonant oscillation mode and $\tau_D$ is the time constant of damping factors.

The maximum magnitude of displacement is normalized to 1.0. The time axis in FIG. 14 is divided in units of $\tau_R$. Curves 220, 222, and 224 show damped resonant oscillations all having the same resonant period $\tau_R$, but having damping time constant $\tau_D$=0.75 $\tau_R$, 10 $\tau_R$, and 1.25 $\tau_R$, respectively. Curve 226 shows the exponential damping portion of Equation 6 for the case of curve 224. Curve 228 illustrates the electrical pulse that activated the thermo-mechanical activators initially. Activation pulse duration, $\tau_p$, should be less than one-quarter the resonant period, i.e. $\tau_p<\frac{1}{4}\tau_R$, to avoid the situation of contention between the natural spring recoil of the cantilevered element and the thermo-mechanical force introduced by the input heat energy pulse.

The geometrical parameters for cantilevered elements given in the table of FIG. 13 are typical of liquid emitter devices that are appropriate for high quality ink jet printing and other liquid drop emitter applications utilizing drop volumes of approximately 10 pL or less. The highest resonant frequency of these experimental devices was found to be 74 kHz, having a period of 13.5 $\mu$sec. Consequently, it is preferred to operate such a liquid drop emitter according to the present inventions by insuring that all input heat pulses have a time duration of approximately 3 $\mu$sec or less.

Further methods of operating a liquid drop emitter according to the present inventions are implemented utilizing drops having substantially different volumes and substantially different velocities. For some applications, the errors that may arise in the drop placement at a predetermined receiver location are acceptable within certain limits. For example, in ink jet printing applications it may be that the printing of "draft" quality images will be acceptable even though all drops are not printed substantially at the predetermined raster location. In a microdosiometer application it may be required that metered drops land within a sample catch area that is large enough to tolerate some misplacement in the drop trajectory.

Figure 15:
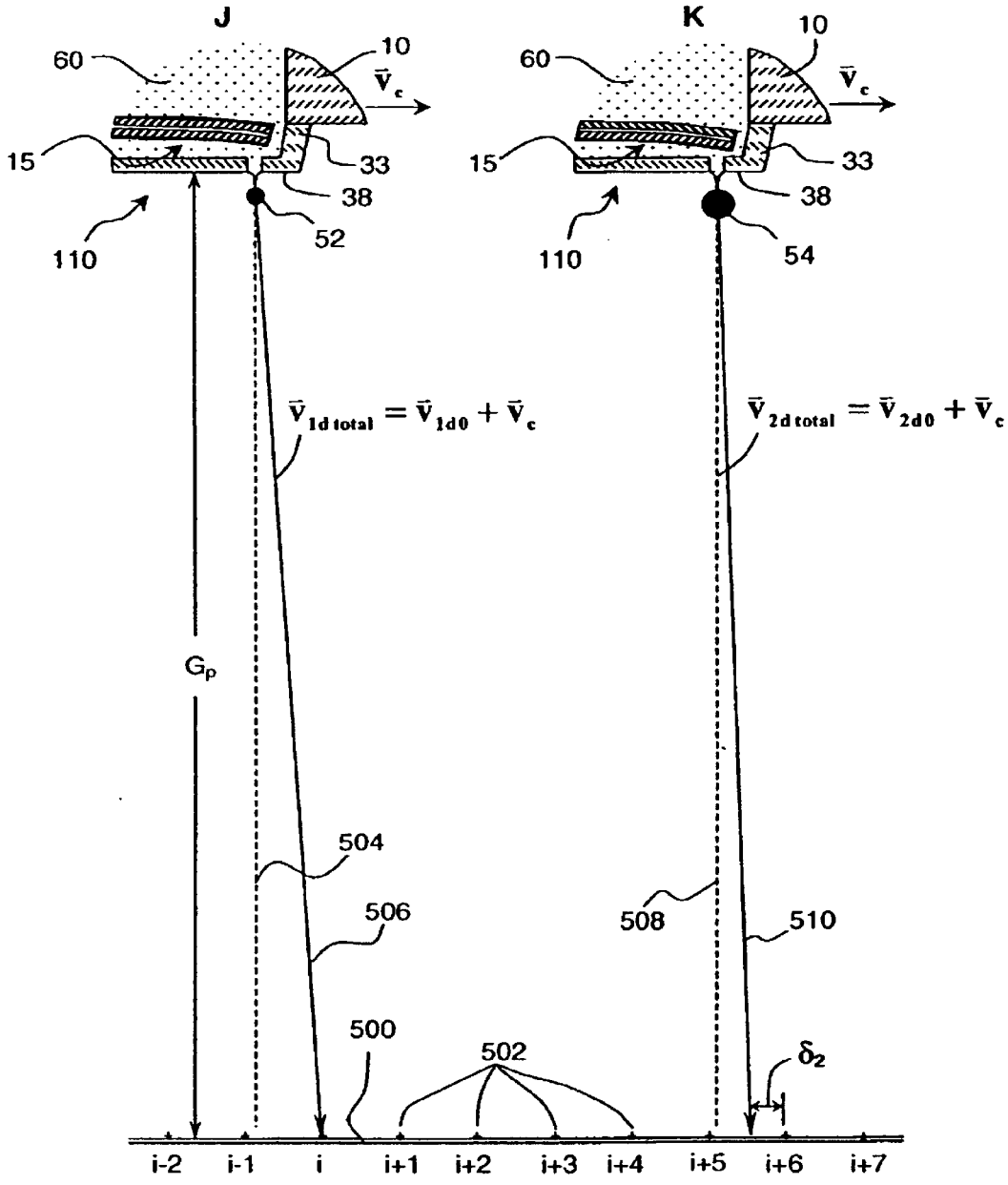
FIG. 15 illustrates the effect of varying drop velocity on drop placement at a print plane.

FIG. 15 illustrates the drop placement error that may be associated with varying drop velocity. In FIG. 15 a cut-away portion of a thermo-mechanically actuated drop emitter 110 is shown in side view in two positions indicated as "J" and "K". The cut-away portion of drop emitter 110 is drawn after FIG. 4*b* showing the moment of drop emission. In position J, a first drop 52 having a first volume $V_{1d}$ and an emission velocity $v_{1d0}$ is emitted. In position K, a second drop 54 having a second volume $V_{2d}$ and a second emission velocity $v_{2d0}$ is emitted. In the illustrated example, first drop 52 is selected as a small volume drop and travels at a slow velocity. Second drop 54 is selected as a substantially larger volume drop, $V_{2d}>V_{1d}$, and travels at a substantially faster velocity, $v_{2d0}>v_{1d0}$.

First and second drops 52 and 54 are intended to land at certain predetermined locations 502 on receiver or print plane 500. For example, predetermined locations 502 are labeled (i−2), (i−1), (i), . . . , (i+7), and indicated by small plus signs. In the case of an ink jet printing application, predetermined locations 502 are individual pixel raster positions along a single scan line. For the example of FIG. 15, first drop 52 is intended to land on predetermined location (i) and second drop 54 is intended to land on predetermined location (i+6). The receiver or print plane 500 is located a firing distance $G_p$ from the nozzle plane of drop emitter 110. Drop emitter 110 is illustrated moving at a velocity $v_c$ in a direction parallel to print plane 500, for example by means of a printhead carriage.

Because drop emitter 110 is moving at a vector velocity $\bar{v}_c$ with respect to the predetermined locations 502 at print plane 500, the trajectory of emitted drops will follow the direction of the vector sum, $\bar{v}_{d\ total}$, of $\bar{v}_c$ and the drop emission velocity vector $\bar{v}_{d0}$, the velocity of a drop if the drop emitter were at rest. Straight line trajectory 506 in FIG. 15 illustrates the flight path of first drop 52 along the direction of $\bar{v}_{1d\ total}$. Straight line trajectory 510 in FIG. 15 illustrates the flight path of second drop 54 along the direction of $\bar{v}_{2d\ total}$. Dotted lines 504 and 508 in FIG. 15 indicate the position of drop emitter 110 with respect to predetermined print plane locations 502 at the moment of the emission of first drop 52 and second drop 54, respectively.

First drop 52 is emitted when the nozzle of drop emitter 110 is opposite a print plane location just past predetermined location (i−1). Second drop 54 is emitted when the nozzle of drop emitter 110 is similarly opposite a print plane location just past predetermined location (i+5). The emission of first drop 52 is timed to occur just after passing predetermined location (i−1) so that it will land on predetermined print plane location (i). The emission of second drop 54 is similarly timed to occur just after passing predetermined location (i+5) and is intended to, but does not, fall on predetermined location (i+6), because it is traveling too fast. Second drop 54 lands at a point on the receiver 500 in between predetermined locations (i+5) and (i+6), an error distance δ2 away from predetermined location (i+6).

Error distance $\delta_2$ adversely affects the quality of performance of the liquid drop emitter in a fashion depending on the specific application. For example, in the case of an ink jet printing application, misplacement of some of the print drops by a distance $\delta_2$ away from the intended pixel raster positions may cause perceptible anomalies, defects, in the image. For a microdosiometer application, the drop may fall outside of an intended chemical analysis site, leading to a false chemical measurement.

Some preferred embodiments of the present inventions include methods of operating a liquid drop emitter to emit drops having substantially different drop volumes and substantially different velocities wherein the range of permitted velocities is predetermined to bound the drop velocity related drop placement errors. The range of permitted velocities may be different for different applications or application modes. For example, in ink jet printing, different image quality levels may allow different levels of drop placement error, hence a different permitted range of drop velocities.

Let $v_{d\ max}$ and $v_{d\ min}$ be the maximum and minimum predetermined, permitted, drop velocities to bound the variation of drop placement at the print plane below a predetermined maximum error amount, $\delta_{max}$. The following relationship governs the permitted drop velocities:

$$\left(\frac{1}{v_{d\min}}-\frac{1}{v_{d\max}}\right)\leq\frac{\delta_{\max}}{G_p v_c}. \tag{7}$$

It is common that the minimum velocity permitted, $v_{d\ min}$, is selected in recognition of other drop misplacement error sources, especially off-axis tugging on the liquid jet arising from wetting anomalies and debris at the nozzle exit. For example, it may be the case that these nozzle front face effects are of such magnitude that a minimum drop velocity of 3–5 m/sec is necessary to bound drop placement errors from these sources. The maximum permitted velocity, $v_{d\ max}$, may then be selected to satisfy above Equation 7.

A representative example for an ink jet printing application is: permitted maximum variation in drop placement $\delta_{max}$+30 $\mu$m; firing distance $G_p$=1000 $\mu$m; printhead carriage velocity $v_c$=0.25 m/sec; and $v_{d\ min}$=4 m/sec. From Equation 7, the permitted $v_{d\ max}$ is then:

$$v_{d\max} \le \frac{G_p v_c v_{d\min}}{G_p v_c - \delta_{\max} v_{d\min}} = 7.7 \text{ m/sec.} \quad (8)$$

Given the parameters of this example and the drop emitter performance for the experimental conditions disclosed in FIG. 11, drops having volumes over the range of ~3.1 pL to 4.1 pL, and velocities of ~4 m/sec. to 7.7 m/sec., could be selected for use without incurring drop velocity induced placement errors in excess of ~30 $\mu$m.

Methods of operation of liquid drop emitters that emit drops having substantially different volumes have been disclosed wherein the drop velocities are adjusted to be substantially equal by proper selection of both the input power and the pulse time duration of applied heat pulses. Other methods of operating have been disclosed wherein a range of drop velocities is permitted, said range being bounded by a predetermined permitted maximum drop placement error. The inventors of the present inventions also comprehend that the principles of these methods of operation may be combined to permit a wider range of drop volumes to be used. That is, adjustment of the power and time duration of activating input heat pulses may be used to provide a wider range of drop volumes emitted at a narrowed range of velocities, wherein the narrowed velocity range is selected to satisfy above Equation 7.

Figure 16A:
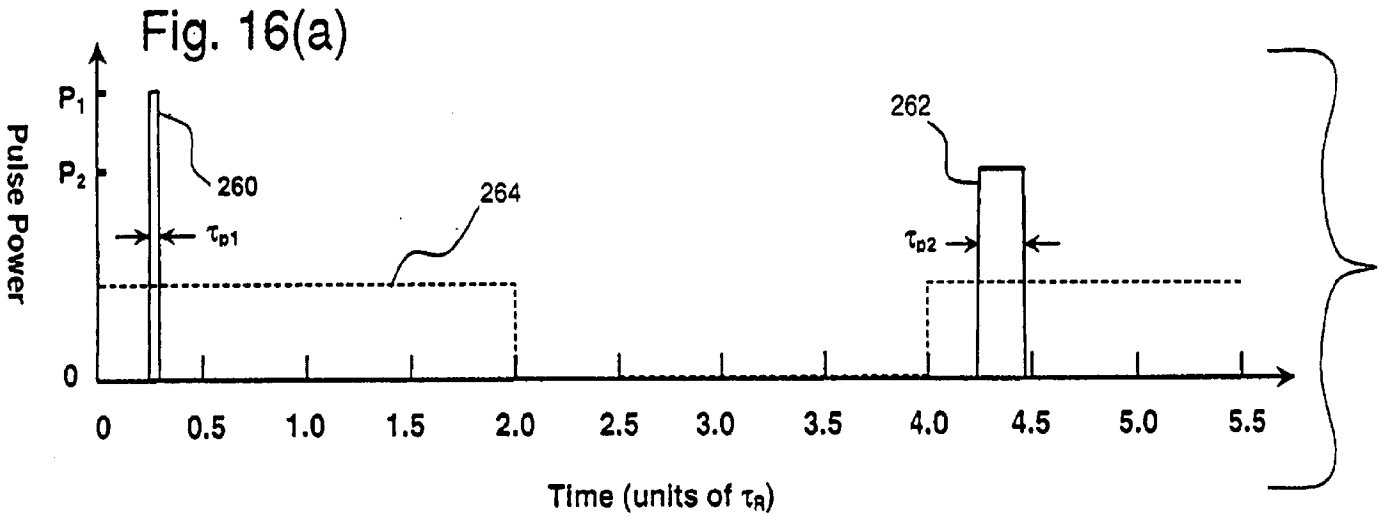
FIGS. 16(*a*) and 16(*b*) illustrate the heat pulse parameters associated with two alternative methods of operating according to the present inventions.
Figure 16B:
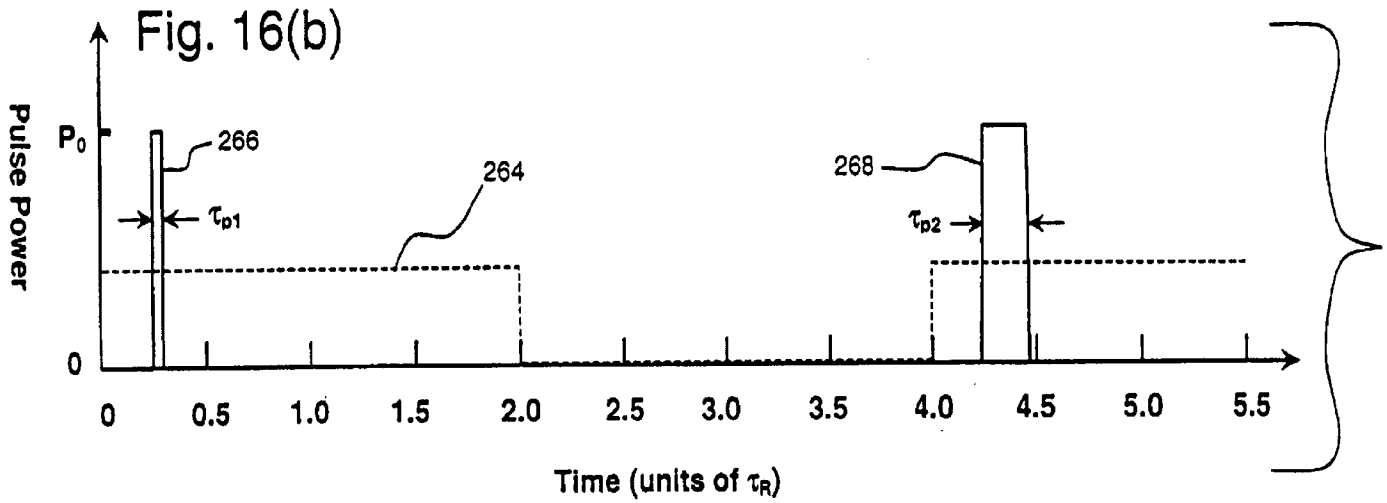

FIGS. 16*a* and 16*b* illustrate input heat pulse parameters that might be used to generate first and second drops as illustrated in FIG. 15. In FIG. 16*a* a first heat pulse 260 is applied having a first power $P_1$, a first pulse time duration $\tau_{p1}$, and first energy $E_1=P_1\tau_{p1}$ to cause the emission of a small drop 52. A second heat pulse 262 is applied having a second power $P_2$, a second pulse time duration $\tau_{p2}$ and second energy $E_2=P_2\tau_{p2}$ to cause the emission of a large drop 54. In the example of FIG. 16*a*, the power and pulse time duration parameters are adjusted to provide both the energy levels to generate large and small drops, $E_2>E_1$, and the adjustments of pulse power and pulse time duration necessary to maintain a substantially constant drop velocity, i.e., $\tau_{p2}>\tau_{p1}$, $P_2<P_1$, and $v_1=v_2$.

The time axes in FIGS. 16*a* and 16*b* are drawn in units of $\tau_R$, the fundamental resonant period of a thermo-mechanical actuator. This has been done to further emphasize that the heat pulse time durations used are preferably less than ¼$\tau_R$. First and second drop firing pulses 260 and 262 are initiated by a clock signal 264, which is illustrated to have a period, $\tau_C$=4 $\tau_R$. In an ink jet printing application clock signal 264 is preferably synchronized to the movement of the printhead relative to predetermined pixel locations, rasters, at the print plane by some spatial encoding means. In the example of FIGS. 16*a* and 16*b*, the drop firing pulses are initiated at a time ~¼$\tau_R$ following the low-to-high transition of clock signal 264. The low-to-high clock signal transition of clock signal 264 is a clock period start which may be used to time-reference events within a clock period. For the example of FIG. 16*a* wherein the drop velocities are substantially equal, the first and second drops will follow trajectories that take them to predetermined pixel locations at the print plane.

In FIG. 16*b* a first heat pulse 266 is applied having a power $P_0$, a first pulse time duration $\tau_{p1}$ and first energy $E_1=P_0\tau_{p1}$ to cause the emission of a small drop 52. A second heat pulse 268 is applied having also a power $P_0$, a second pulse time duration $\tau_{p2}$ and second energy $E_2=P_0\tau_{p2}$ to cause the emission of a large drop 54. In the example of FIG. 16*b*, pulse time duration parameters are adjusted to provide the energy levels to generate large and small drops, $E_2>E_1$. However a same power level, $P_0$, is used, causing large drop 54 to be emitted at a higher velocity than small drop 52, $v_2>v_1$. Consequently, large drop 54 will arrive more quickly at the print plane and will be misplaced by a placement error distance as illustrated in FIG. 15.

Alternate preferred methods of operating liquid drop emitters to emit drops of substantially different volumes at substantially different velocities may be carried out by adjusting the time of application of activating heat pulses within a clock signal period. That is, in order to compensate for the quicker travel time to the print plane of faster drops, the heat pulse application may be delayed relative to that of a slower drop. Especially for high quality ink jet printing applications, it is important that each print drop arrive at a predetermined location on the print plane. A clock signal, synchronized to the printhead-receiver motion, may be used to manage the timing of applied heat pulses, introducing an appropriate amount of time delay to synchronize the arrival of different velocity drops at the intended predetermined locations on the receiver.

An appropriate amount of time delay may be introduced to synchronize the arrival of drops at predetermined locations on the receiver by associating a time delay factor, $t_d$, with other heat pulse parameters, power and pulse time duration, used to generate a selected drop volume. For example, in the approach illustrated in FIG. 16*b*, wherein different drop volumes are generated using a constant pulse power and different pulse duration times, a time delay quantity is associated with each pulse time duration. Longer heat pulse durations will generate larger and faster drops and have larger associated time delay factors.

Figure 17:
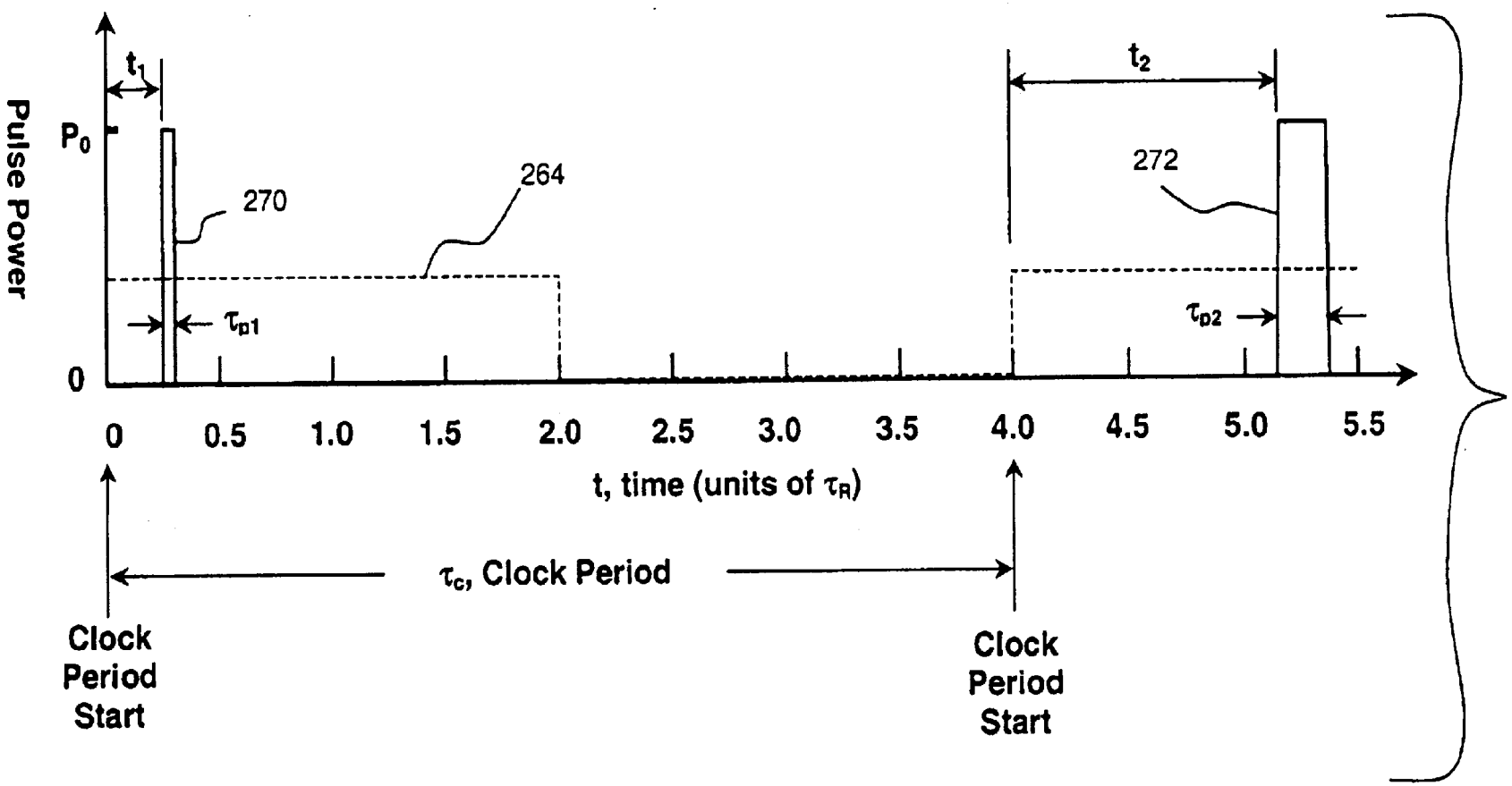
FIG. 17 illustrates the heat pulse parameters associated with some alternative methods of operating an ink jet printhead according to the present inventions.

A preferred method of operation utilizing time delay factors is illustrated in FIG. 17. The method disclosed in FIG. 17 is similar to the method illustrated by FIG. 16*b* except that a unique time delay factor is associated with each applied heat pulse. Heat pulse 270 in FIG. 17 generates a small first drop 52. Heat pulse 270 is initiated after a delay time, $t_1$~0.25 $\tau_R$, following a low-to-high transition, the clock period start, of clock signal 264. Time delay $t_1$ is selected so that first small drop 52 will arrive at a first intended raster position on the receiver.

Heat pulse 272 in FIG. 17 generates a large second drop 54 that will be traveling at a substantially higher velocity than first small drop 52, as has been previously discussed. Heat pulse 272 is initiated after a larger time delay, $t_2$~1.15 $\tau_R$, following a next clock period start. The larger time delay, $t_2$, is calculated to compensate for the shorter transit time from drop emitter to receiver of second large drop 54 relative to first small drop 52. Large second drop 54 will arrive at a second raster position, adjacent to the first in the example of FIG. 17. The second drop placement error that will occur in the example method of operating of FIG. 16*b* is removed by the use of the larger time delay $t_2$ in the method according to FIG. 17.

Figure 18:
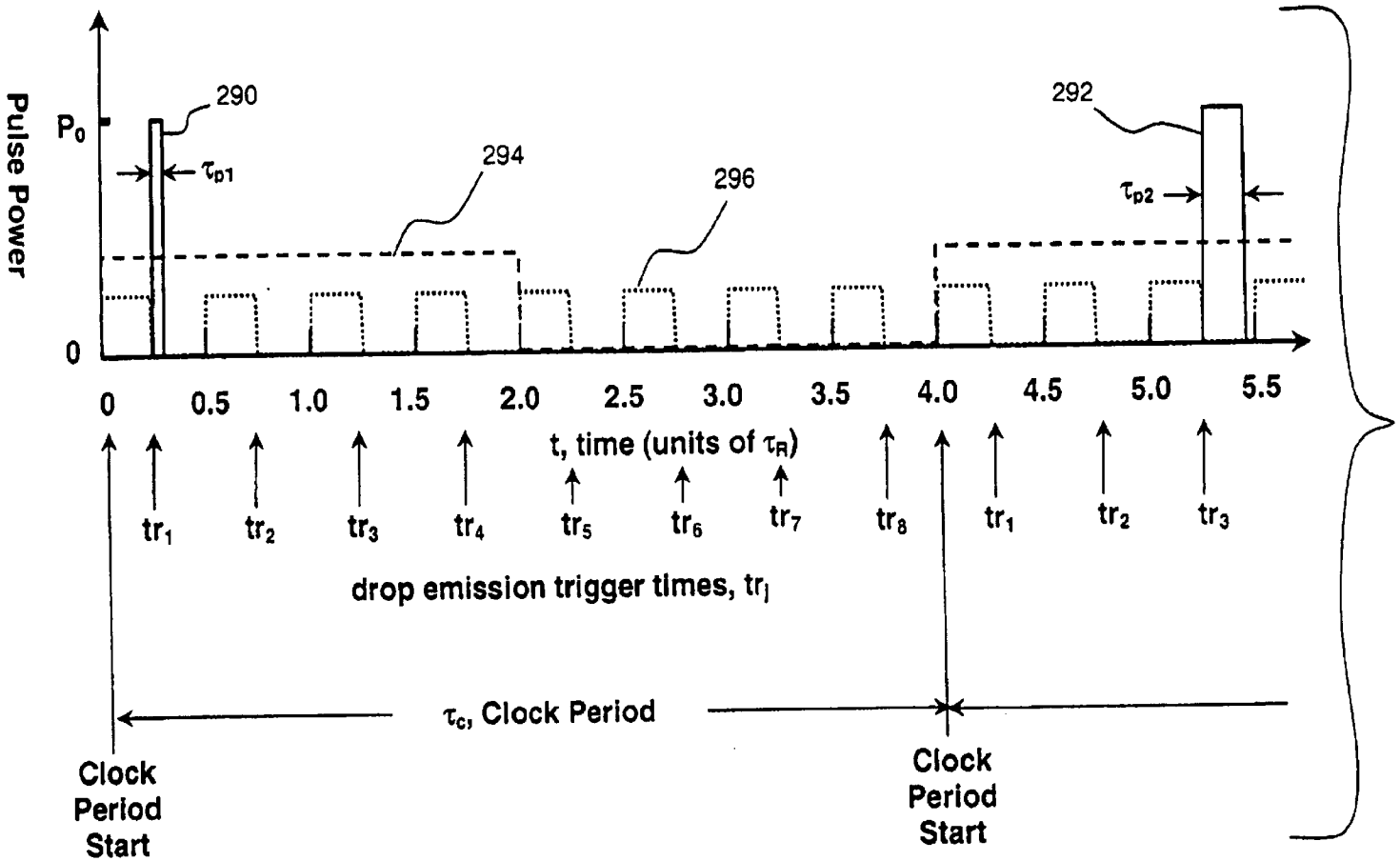
FIG. 18 illustrates the heat pulse parameters associated with other preferred methods of operating an ink jet printhead according to the present invention.

An alternate preferred method of providing time delay compensation to synchronize the arrival of drops having different velocities at predetermined locations in the print plane is illustrated by FIG. 18. For these preferred methods a clock signal 294 is divided into a number of sub-clocks 296 that provide a number of drop emission trigger edges within each clock period. For the example illustrated in FIG. 18, sub-clock signal 296 provides eight high-to-low transitions per clock period, which may be used as eight trigger times, $tr_1$ to $tr_8$. The subordinate trigger edges are sometimes referred to as "phases" of the clock signal. While illustrated as equally spaced in FIG. 18, some number of trigger edges may be provided at non-equal time spacings within the clock period.

In the alternate preferred method of operating a liquid drop emitter illustrated in FIG. 18, each drop volume that is to be emitted is associated with one of the available trigger edges. In FIG. 18, first drop heat pulse 290 is associated with trigger edge $tr_1$ and second drop heat pulse 292 is associated with trigger edge $tr_3$. In the example of FIG. 18, the total clock period, $\tau_c$, is divided into eight equal parts by sub-clock 296 and the trigger edges are chosen to be the high-to-low transitions rather than a low-to-high edge as is used for the clock period start. Each drop volume choice is associated with the trigger edge that will result in the least drop placement error due to each drop velocity.

Comparing the methods of operating illustrated in FIG. 17 to that of FIG. 18 it may be seen that they are nearly the same. The second drop is emitted after a delay of 1.25 $\tau_R$ following the second clock period start in the method of FIG. 18 whereas it is emitted after a time delay of 1.15 $\tau_R$ in the method of FIG. 17. The method of FIG. 17, wherein a particular time delay is associated with each drop volume, can result in the smaller drop placement errors than the method of FIG. 18 which is limited to choosing a "closest appropriate" trigger edge. However a finer structure of trigger edges may be created to further minimize the error in having to select from a finite set of delay times.

The methods of FIG. 18 may also be implemented by generating a finite set of sub-clock trigger edges to accompany a finite set of emitted drop volumes. For example, a system might be configured to emit three discrete drop volumes, each drop size having an associated specific velocity and optimum delay time. A sub-clock is then constructed to provide three trigger edges that occur at the optimum delay times. Such a system would operate as if the signal clock had three phases, one for each drop size. Image data which directs that a given pixel location should be printed with one of the three drops sizes, or none, could then be organized into three binary drop command files, drop or no drop, one for each of the three phases, and executed in time-interleaved fashion.

A potential advantage of the preferred methods of the present inventions, which utilize drops having different velocities, is that a variable drop volume system may be constructed and operated using a constant power input source and other parameters managed via various timing means. Such an approach may offer lower cost and higher reliability hardware as compared to an approach in which the input power must be finely adjusted on a drop-by-drop basis to equalize drop velocities.

The foregoing description of the present inventions was primarily directed at thermo-mechanical actuators having a laminated construction comprised of a deflector layer and a top layer, that is, a bi-layer device. However, the inventors of the present inventions contemplate that any construction configuration of a thermo-mechanical actuator that is useful in a liquid drop emitter may be used in practicing the inventions. In particular, thermo-mechanical actuators having multiple deflector layers may be operated according to the methods of the present inventions, in a fashion similar to the single deflector layer constructions described in detail herein.

While much of the foregoing description was directed to the configuration and operation of a single thermo-mechanical actuator or liquid drop emitter, it should be understood that the present invention is applicable to forming arrays and assemblies of multiple drop emitter units. Also it should be understood that thermo-mechanical actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

Parts List

10 device microelectronic substrate
11 upper liquid chamber
12 lower liquid chamber
13 clearance gap between thermo-mechanical actuator and arcuate liquid chamber walls
14 liquid chamber wall edge at cantilever anchor
15 thermo-mechanical actuator
16 lower liquid chamber arcuate wall portion
17 anchor portion of thermo-mechanical actuator
18 clearance opening removed in passivation layer 22
19 side edges of the moveable cantilevered element
20 cantilevered element of a thermo-mechanical actuator
22 lower passivation layer
24 deflector layer
26 top layer
28 cantilevered element free end
29 patterned sacrificial layer material
30 nozzle
31 planar upper surface of the sacrificial layer material
33 upper liquid chamber structure
34 arcuate edge of free end 28
35 openings in passivation layer 22 for liquid refill pathway
36 upper liquid chamber arcuate wall portion
38 planar surface of upper liquid chamber structure 33 having nozzle 30
42 electrical input pad
44 electrical input pad
50 liquid drop
52 small volume drop
54 large volume drop
60 working fluid
80 support structure
100 ink jet printhead
110 drop emitter unit
200 electrical pulse source
300 controller
400 image data source
500 receiver or print plane
502 print raster positions

What is claimed is:

1. A method for operating a liquid drop emitter for emitting liquid drops of substantially different volumes having substantially a same target velocity $v_0$, said liquid drop emitter comprising a chamber, filled with a liquid, having a nozzle for emitting drops of the liquid, a thermo-mechanical actuator having a moveable portion within the chamber for applying pressure to the liquid at the nozzle, and apparatus adapted to apply heat pulses to the thermo-mechanical actuator, the method for operating comprising:

(a) applying a first heat pulse having a first power $P_1$, first pulse duration $\tau_{p1}$, and first energy $E_1=P_{1\times\tau p1}$, displacing the movable portion of the actuator so that a drop is emitted having a first drop volume $V_{d1}$, and traveling substantially at the target velocity $v_0$; and (b) applying a second heat pulse having a second power $P_2$, second pulse duration $\tau_{p2}$, and second energy $E_2=P_2\times\tau_{p2}$, displacing the movable portion of the actuator so that a drop is emitted having a second drop volume $V_{d2}$ and traveling substantially at the target velocity $v_0$, wherein $V_{d2}>V_{d1}$, $E_2>E_1$, $\tau_{p2}>\tau_{p1}$ and $P_2<P_1$.

2. The method of claim 1 wherein the liquid drop emitter is a drop-on-demand ink jet printhead and the liquid is an ink for printing image data.

3. The method of claim 1 wherein the thermo-mechanical actuator is configured as a cantilever extending from a wall of the chamber and having a free end adjacent the nozzle and moveable within the chamber.

4. The method of claim 3 wherein the thermo-mechanical actuator exhibits a damped mechanical resonance having a fundamental period of $\tau_R$ and $\tau_{p2}<\frac{1}{4}\tau_R$.

5. The method of claim 4 wherein the fundamental period $\tau_R\leqq 20$ microseconds and the second pulse duration $\tau_{p2}\leqq 4$ microseconds.

6. The method of claim 3 wherein the free end has a tip perimeter having an arcuate shape and the chamber has an arcuate chamber portion generally surrounding the free end and spaced away by a clearance distance.

7. The method of claim 6 wherein the arcuate chamber portion surrounds the tip perimeter for at least 180 degrees of arc.

8. The method of claim 6 wherein the clearance distance is 3 microns or less.

9. The method of claim 1 wherein the thermo-mechanical actuator includes a deflector layer constructed of a deflector material having a high coefficient of thermal expansion and a top layer, attached to the deflector layer, constructed of a top material having a low coefficient of thermal expansion.

10. The method of claim 9 wherein the deflector material is electrically resistive and the apparatus adapted to apply a heat pulse includes a resistive heater formed in the deflector layer.

11. The method of claim 9 wherein the deflector material is titanium aluminide.

12. A liquid drop emitter for emitting liquid drops of different volumes having substantially a same target velocity $v_0$, said liquid drop emitter comprising:

(a) a chamber, formed in a substrate, filled with a liquid and having a nozzle for emitting drops of the liquid and having an arcuate chamber portion;

(b) a thermo-mechanical actuator having a cantilevered element extending from a wall of the chamber and having a free end with a tip perimeter having an arcuate shape, the tip perimeter spaced away from the arcuate chamber portion by a clearance distance and moveable within the arcuate chamber portion for applying pressure to the liquid at the nozzle;

(c) apparatus adapted to apply heat pulses to the thermo-mechanical actuator according to the method of claim 1 wherein drops having substantially different volumes are emitted at substantially the same target velocity $v_0$.

13. A method for operating a liquid drop emitter for emitting liquid drops of substantially different volumes having a drop velocity that is within a predetermined drop velocity range, $v_{d\ min}$ to $v_{d\ max}$, said liquid drop emitter comprising a chamber, filled with a liquid, having a nozzle for emitting drops of the liquid, a thermo-mechanical actuator having a moveable portion within the chamber for applying pressure to the liquid at the nozzle, and apparatus adapted to apply heat pulses to the thermo-mechanical actuator, the method for operating comprising:

(a) selecting a maximum drop velocity range, $v_{d\ min}$ to $v_{d\ max}$;

(a) applying a first heat pulse having a first power $P_1$, first pulse duration $\tau_{p1}$, and first energy $E_1=P_1\times\tau_{p1}$, displacing the movable portion of the actuator so that a drop is emitted having a first drop volume $V_{d1}$ and traveling at a first velocity, $v_{1d}$, wherein $v_{d\ min}\leqq v_{1d}<v_{d\ max}$; and (c) applying a second heat pulse having a second power $P_2$, second pulse duration $\tau_{p2}$, and second energy $E_2=P_2\times\tau_{p2}$, displacing the movable portion of the actuator so that a drop is emitted having a second drop volume $V_{d2}$ and traveling at a second velocity, $v_{2d}$ wherein $v_{1d}<v_{2d}\leqq v_{d\ max}$, and wherein $V_{d2}$ is substantially greater than $V_{d1}$, $E_2>E_1$, and $\tau_{p2}>\tau_{p1}$.

14. The method of claim 13 wherein the liquid drop emitter is a drop-on-demand ink jet printhead and the liquid is an ink for printing image data.

15. The method of claim 14 wherein the drop velocity range, $v_{d\ min}$ to $v_{d\ max}$, is selected to achieve an image quality characteristic.

16. The method of claim 13 wherein the thermo-mechanical actuator is configured as a cantilever extending from a wall of the chamber and having a free end adjacent the nozzle and moveable within the chamber.

17. The method of claim 16 wherein the thermo-mechanical actuator exhibits a damped mechanical resonance having a fundamental period of $\tau_R$ and $\tau_{p2}<\frac{1}{4}\tau_R$.

18. The method of claim 17 wherein the fundamental period $\tau_R<20$ microseconds and the second pulse duration $\tau_{p2}\leqq 4$ microseconds.

19. The method of claim 16 wherein the free end has a tip perimeter having an arcuate shape and the chamber has an arcuate chamber portion generally surrounding the free end and spaced away by a clearance distance.

20. The method of claim 19 wherein the arcuate chamber portion surrounds the tip perimeter for at least 180 degrees of arc.

21. The method of claim 19 wherein the clearance distance is 3 microns or less.

22. The method of claim 13 wherein the thermo-mechanical actuator includes a deflector layer constructed of a deflector material having a high coefficient of thermal expansion and a top layer, attached to the deflector layer, constructed of a top material having a low coefficient of thermal expansion.

23. The method of claim 22 wherein the deflector material is electrically resistive and the apparatus adapted to apply a heat pulse includes a resistive heater formed in the deflector layer.

24. The method of claim 23 wherein the deflector material is titanium aluminide.

25. The method of claim 13 wherein $P_2=P_1$.

26. A liquid drop emitter for emitting liquid drops of substantially different volumes having a drop velocity that is within a predetermined drop velocity range, $v_{d\ min}$ to $v_{d\ max}$, said liquid drop emitter comprising:

(a) a chamber, formed in a substrate, filled with a liquid and having a nozzle for emitting drops of the liquid and having an arcuate chamber portion;

(b) a thermo-mechanical actuator having a cantilevered element extending a from a wall of the chamber and having a free end with a tip perimeter having an arcuate shape, the tip perimeter spaced away from the arcuate chamber portion by a clearance distance and moveable within the arcuate chamber portion for applying pressure to the liquid at the nozzle;

(c) apparatus adapted to apply heat pulses to the thermo-mechanical actuator according to the method of claim 13 wherein drops having substantially different volumes are emitted at drop velocities within the range $v_{d\ min}$ to $v_{d\ max}$.

27. A method for operating an ink jet printhead for emitting drops having a plurality of volumes, $V_{di}$, with associated velocities, $v_{id}$, and synchronized arrival times, $t_a$, at a print plane; said ink jet printhead comprising at least one chamber having a nozzle for emitting drops of an ink filling the chamber, a thermo-mechanical actuator for applying pressure to the ink, apparatus adapted for applying heat pulses to the thermo-mechanical actuator, a source of heat pulses, and controller apparatus adapted for generating clock signals and determining the parameters of the heat pulses, the method for operating comprising:

(a) generating a clock signal having a clock period and a clock period start, for organizing the timing of the application of heat pulses so that at least one drop, or no drop, is emitted per clock period;

(b) determining heat pulse parameters to be associated with each drop volume $V_{di}$ having a velocity $v_{id}$, said heat pulse parameters comprising a pulse duration $\tau_{pi}$, a time delay $t_{di}$, and a power $P_0$, wherein the time delay $t_{di}$ is selected to result in an arrival time of approximately $t_a$ at the print plane;

(c) receiving a command to emit a drop of volume $V_{di}$ during a clock period;

(d) waiting time $t_{di}$ from the clock period start; and (e) applying a heat pulse having pulse duration $\tau_{pi}$ and power $P_0$ causing the emission of a drop of volume $V_{di}$ and velocity $v_{id}$ that arrives at the print plane at a time of approximately $t_a$ after the clock period start.

28. The method of claim 27 wherein the thermo-mechanical actuator is configured as a cantilever extending from a wall of the chamber and having a free end adjacent the nozzle and moveable within the chamber.

29. The method of claim 28 wherein the thermo-mechanical actuator exhibits a damped mechanical resonance having a fundamental period of $\tau_R$ and $\tau_{pi}<\frac{1}{4}\tau_R$.

30. The method of claim 27 wherein the free end has a tip perimeter having an arcuate shape and the chamber has an arcuate chamber portion generally surrounding the free end and spaced away by a clearance distance.

31. The method of claim 27 wherein the thermo-mechanical actuator includes a deflector layer constructed of a deflector material having a high coefficient of thermal expansion and a top layer, attached to the deflector layer, constructed of a top material having a low coefficient of thermal expansion.

32. The method of claim 31 wherein the deflector material is electrically resistive and the apparatus adapted to apply a heat pulse includes a resistive heater formed in the deflector layer.

33. The method of claim 23 wherein the deflector material is titanium aluminide.

34. A method for operating an ink jet printhead for emitting drops having a plurality of volumes, $V_{di}$, with associated velocities, $v_{id}$, and synchronized arrival times, $t_a$, at a print plane; said ink jet printhead comprising at least one chamber having a nozzle for emitting drops of an ink filling the chamber, a thermo-mechanical actuator for applying pressure to the ink, apparatus adapted for applying heat pulses to the thermo-mechanical actuator, a source of heat pulses, and controller apparatus adapted for generating clock signals and determining the parameters of the heat pulses, the method for operating comprising:

(a) generating a clock signal having a clock period $\tau_c$, a clock period start, and a plurality of intermediate drop emission trigger times $tr_j$, $tr_j<\tau_c$, following the clock period start for organizing the timing of the application of heat pulses so that at least one drop, or no drop, is emitted per clock period;

(b) determining heat pulse parameters to be associated with each drop volume $V_{di}$ having a velocity $v_{id}$, said heat pulse parameters comprising a pulse duration $\tau_{pi}$, a drop emission trigger time, $tr_i$, and a power $P_0$, wherein the trigger time is selected to result in an arrival time of approximately $t_a$ at the print plane;

(c) receiving a command to emit a drop of volume $V_{di}$ during a clock period;

(d) waiting until trigger time $tr_i$; and (e) applying a heat pulse having pulse duration $\tau_{pi}$ and power $P_0$ causing the emission of a drop of volume $V_{di}$ and velocity $v_{id}$ that arrives at the print plane at a time of approximately $t_a$ after the clock period start.

35. The method of claim 34 wherein the thermo-mechanical actuator is configured as a cantilever extending from a wall of the chamber and having a free end adjacent the nozzle and moveable within the chamber.

36. The method of claim 34 wherein the thermo-mechanical actuator exhibits a damped mechanical resonance having a fundamental period of $\tau_R$ and $\tau_{pi}<\tau_R$.

37. The method of claim 34 wherein the free end has a tip perimeter having an arcuate shape and the chamber has an arcuate chamber portion generally surrounding the free end and spaced away by a clearance distance.

38. The method of claim 34 wherein the thermo-mechanical actuator includes a deflector layer constructed of a deflector material having a high coefficient of thermal expansion and a top layer, attached to the deflector layer, constructed of a top material having a low coefficient of thermal expansion.

39. The method of claim 38 wherein the deflector material is electrically resistive and the apparatus adapted to apply a heat pulse includes a resistive heater formed in the deflector layer.

40. The method of claim 38 wherein the deflector material is titanium aluminide.

* * * * *